US012552575B2

(12) United States Patent
Sicilian et al.

(10) Patent No.: US 12,552,575 B2
(45) Date of Patent: Feb. 17, 2026

(54) JAR ASSEMBLY

(71) Applicant: ANOMATIC CORPORATION, New Albany, OH (US)

(72) Inventors: Nicholas Sicilian, Gahanna, OH (US); Stephen Eifert, Powell, OH (US)

(73) Assignee: ANOMATIC CORPORATION, New Albany, OH (US)

( * ) Notice: Subject to any disclaimer, the term of this patent is extended or adjusted under 35 U.S.C. 154(b) by 0 days.

(21) Appl. No.: 18/504,706

(22) Filed: Nov. 8, 2023

(65) Prior Publication Data

US 2024/0150065 A1 May 9, 2024

Related U.S. Application Data

(60) Continuation-in-part of application No. 18/158,935, filed on Jan. 24, 2023, which is a division of application No. 15/929,382, filed on Apr. 29, 2020, now Pat. No. 11,584,560.

(60) Provisional application No. 62/840,714, filed on Apr. 30, 2019.

(51) Int. Cl.

| | |
|---|---|
| ***B65D 1/26*** | (2006.01) |
| ***B65D 1/02*** | (2006.01) |
| ***B65D 23/02*** | (2006.01) |
| *C25D 11/16* | (2006.01) |

(52) U.S. Cl.

CPC ..... *B65D 1/26* (2013.01); *B65D 1/0246* (2013.01); *B65D 23/02* (2013.01); *B65D 2543/00277* (2013.01); *C25D 11/16* (2013.01)

(58) Field of Classification Search

CPC ..... B65D 1/26; B65D 1/0246; B65D 23/02; B65D 85/72; B65D 41/34; B65D 2543/00277; B65D 1/0215; B65D 23/0885; B65D 2543/00092; B65D 2543/00231; B65D 43/0231; B65D 7/38; C25D 11/16

See application file for complete search history.

(56) References Cited

U.S. PATENT DOCUMENTS

| | | | | |
|---|---|---|---|---|
| 2,081,985 A | | 6/1937 | Cornwell | |
| 2,330,896 A | | 10/1943 | Peabody | |
| 2,785,796 A | * | 3/1957 | Gelardin | A45D 40/10 401/53 |
| 2,866,569 A | | 12/1958 | Morrison | |
| 3,156,279 A | | 11/1964 | Grebowiec et al. | |

(Continued)

FOREIGN PATENT DOCUMENTS

| | | |
|---|---|---|
| CN | 104058177 A | 9/2014 |
| CN | 205256965 U | 5/2016 |

(Continued)

OTHER PUBLICATIONS

Non-Final Office Action for U.S. Appl. No. 15/929,382 issued on Nov. 3, 2021, 20 pages.

(Continued)

*Primary Examiner* — Shawn M Braden

(74) *Attorney, Agent, or Firm* — Vorys, Sater, Seymour and Pease LLP; Rex W. Miller, II

(57) ABSTRACT

The present disclosure is related to readily recyclable jars and lid assemblies for jars. The lid assembly may include an outer lid and either an inner lid or a hoop provided within the outer lid. A thread may be provided on the inner lid or hoop. A liner or seal may be provided.

15 Claims, 17 Drawing Sheets

(56) References Cited

U.S. PATENT DOCUMENTS

| | | | | |
|---|---|---|---|---|
| 3,435,978 | A | 4/1969 | Wittwer | |
| 3,511,403 | A | 5/1970 | Braun | |
| 3,578,223 | A | 5/1971 | Armoul | |
| 3,952,899 | A | 4/1976 | Cooke | |
| 4,011,962 | A | 3/1977 | Favell | |
| 4,053,077 | A | 10/1977 | DeFelice | |
| 4,084,717 | A | 4/1978 | King | |
| 4,139,112 | A | 2/1979 | Cooke | |
| 4,444,324 | A | 4/1984 | Grenell | |
| 4,651,397 | A | 3/1987 | Martin Saint Leon | |
| 5,785,198 | A | 7/1998 | Credle, Jr. | |
| 5,851,634 | A | 12/1998 | Andersen et al. | |
| 6,276,547 | B1 | 8/2001 | Petryna | |
| 7,913,866 | B2 | 3/2011 | Bodenbender | |
| 8,132,578 | B2 | 3/2012 | LoPrete | |
| 8,348,576 | B1 | 1/2013 | Gaw | |
| 8,448,801 | B2 | 5/2013 | Rusnak et al. | |
| 8,678,211 | B1 | 3/2014 | Lin | |
| 10,421,589 | B1 | 9/2019 | Quinn | |
| 10,611,540 | B2 | 4/2020 | Lyzenga et al. | |
| 10,889,885 | B2 | 1/2021 | Perego | |
| 11,278,989 | B2 | 3/2022 | Rudolf et al. | |
| 11,673,157 | B2 | 6/2023 | Perego | |
| 2005/0109726 | A1 | 5/2005 | Alley | |
| 2005/0284835 | A1* | 12/2005 | McKendry | A61M 1/062 215/11.1 |
| 2006/0099363 | A1 | 5/2006 | Farha | |
| 2006/0186081 | A1 | 8/2006 | Reed et al. | |
| 2008/0035646 | A1 | 2/2008 | Smith | |
| 2009/0039080 | A1* | 2/2009 | Bodenbender | A45D 40/0068 220/23.83 |
| 2009/0266737 | A1 | 10/2009 | Cole | |
| 2013/0111726 | A1* | 5/2013 | Krieger | B65D 81/3823 29/428 |
| 2013/0156995 | A1 | 6/2013 | Crutchley et al. | |
| 2014/0312040 | A1 | 10/2014 | Gamelli | |
| 2015/0158657 | A1* | 6/2015 | Olson | A47J 41/028 220/592.27 |
| 2016/0280426 | A1 | 9/2016 | Kim | |
| 2017/0217635 | A1* | 8/2017 | Johnson | B65D 21/08 |
| 2018/0125198 | A1 | 5/2018 | Burditt et al. | |
| 2018/0194049 | A1* | 7/2018 | Wada | B29C 45/1635 |
| 2019/0031386 | A1 | 1/2019 | Ishii et al. | |
| 2019/0166975 | A1 | 6/2019 | Hong | |
| 2019/0315535 | A1* | 10/2019 | Karll | B65D 50/041 |
| 2020/0130901 | A1 | 4/2020 | Karll | |
| 2020/0346813 | A1 | 11/2020 | Campbell | |
| 2022/0312935 | A1 | 10/2022 | Din et al. | |
| 2023/0234747 | A1 | 7/2023 | Campbell | |
| 2023/0331442 | A1 | 10/2023 | Teillard | |
| 2024/0150065 | A1 | 5/2024 | Sicilian et al. | |

FOREIGN PATENT DOCUMENTS

| | | | |
|---|---|---|---|
| CN | 205470510 | U | 8/2016 |
| CN | 208731588 | U | 4/2019 |
| CN | 2088631667 | U | 5/2019 |
| CN | 215603737 | U | 1/2022 |
| DE | 102007060475 | A | 6/2009 |
| EP | 0431915 | A1 | 6/1991 |
| EP | 0897876 | A2 | 2/1999 |
| EP | 1138609 | A1 | 10/2001 |
| EP | 2522762 | A1 | 11/2012 |
| EP | 2522762 | B1 | 12/2013 |
| JP | 2000043910 | A | 2/2000 |
| JP | 2023061505 | A | 5/2023 |
| WO | 2010020926 | A1 | 2/2010 |
| WO | 2023200868 | A1 | 10/2023 |

OTHER PUBLICATIONS

Non-Final Office Action for U.S. Appl. No. 15/929,382 issued on May 5, 2022, 19 pages.

Final Office Action for U.S. Appl. No. 15/929,382 issued on Aug. 22, 2022, 20 pages.

International Search Report and Written Opinion issued Jun. 3, 2024, in International Patent Application No. PCT/US2024/014479, 11 pages.

International Search Report and Written Opinion issued Jul. 20, 2023 for international application No. PCT/US2023/018338, 15 pages.

International Search Report and Written Opinion issued Feb. 19, 2025, for international application No. PCT/US2024/055102, 10 pages.

International Search Report and Written Opinion issued Apr. 25, 2025, for international application No. PCT/US2025/010695, 9 pages.

* cited by examiner

FIG. 13
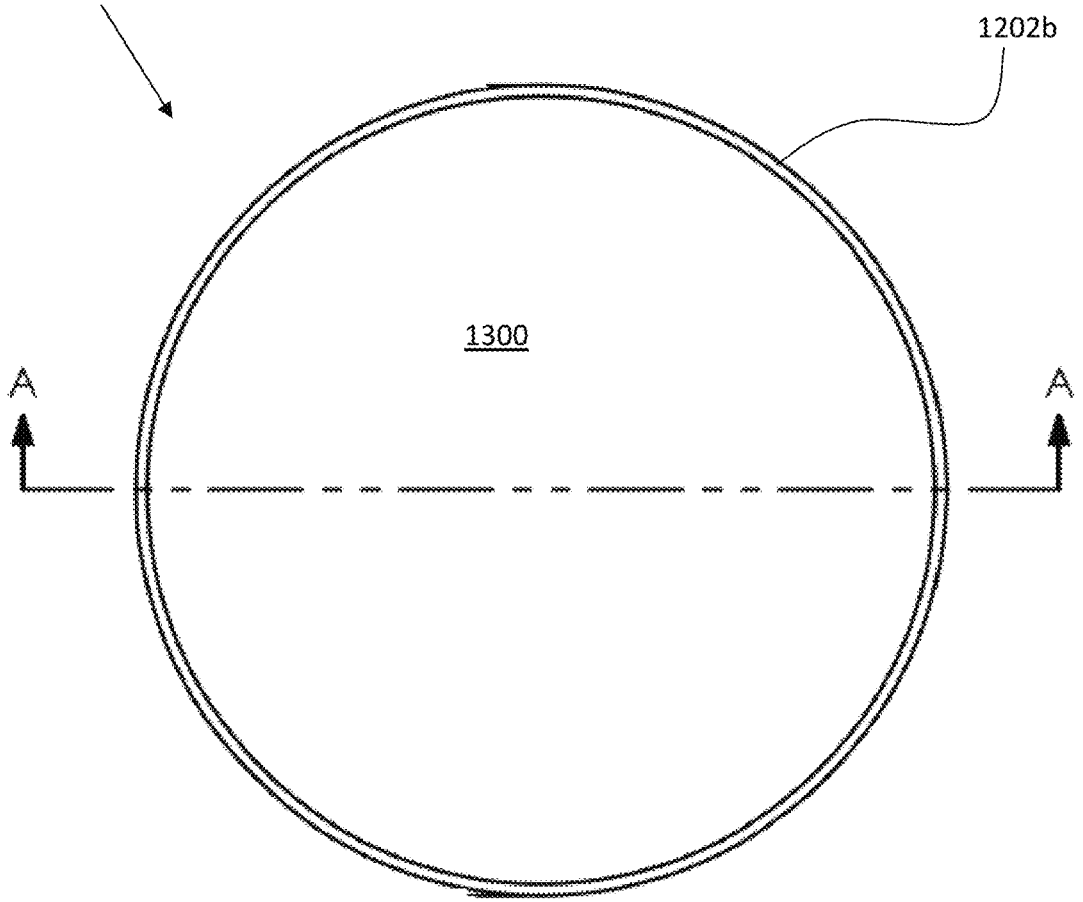
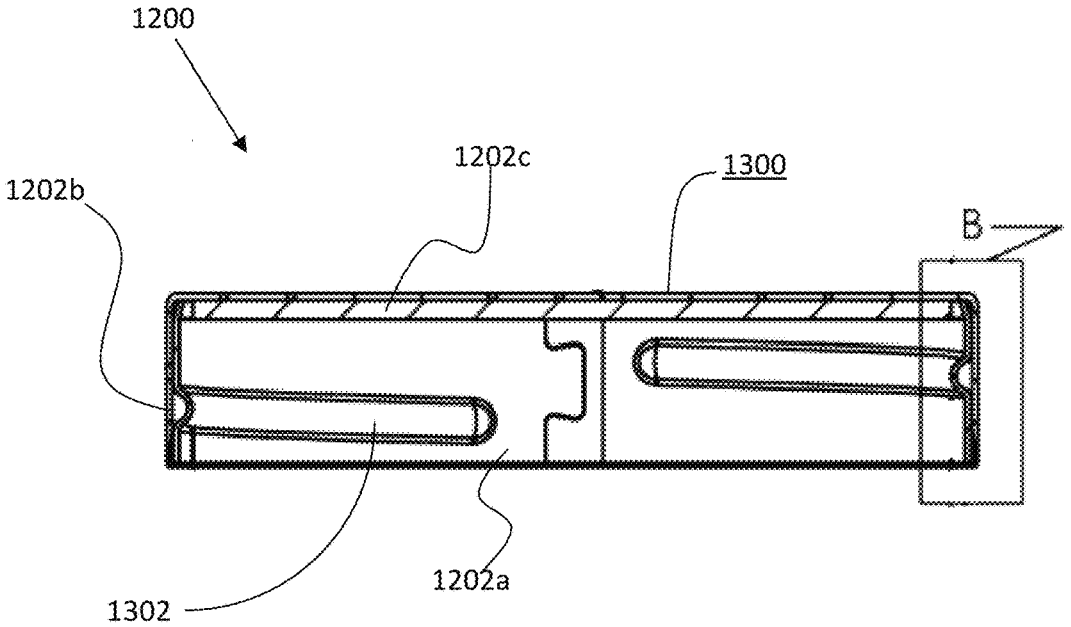
FIG. 14

Section A-A

DETAIL B

JAR ASSEMBLY

CROSS-REFERENCE TO RELATED APPLICATIONS

This application is a continuation-in-part of U.S. patent application Ser. No. 18/158,935 filed 24 Jan. 2023, which is a divisional application of U.S. patent application Ser. No. 15/929,382 filed on 29 Apr. 2020 (now U.S. Pat. No. 11,584,560), which in turn claims priority to and the benefit of U.S. Provisional Application No. 62/840,714 filed 30 Apr. 2019, the contents of all of which are incorporated by reference herein in their entirety.

BACKGROUND

Jars and related containers are used to provide a practical, convenient and means of containing makeup, creams, powders, emulsions and other products for consumers. Once the contents of the container have been fully utilized or the consumer is otherwise ready to dispose of the container, recycling is the most environmentally friendly and preferred disposable option. However, jars currently in distribution for consumer products are often difficult to recycle, e.g. they may have a PET plastic or glass bottom jar portion, a screw-on lid with plastic components, an inner plastic component with an outer metal shroud, metal vacuumized plastic, two piece construction that is difficult to separate, or otherwise are constructed in a manner that makes recycling the container more arduous, causing consumers to default to disposing of the containers in the trash, with attendant negative environmental impact.

Consequently, there is a need for more easily recyclable containers and methods of making the same.

SUMMARY

The present disclosure relates to jars with improved recyclability.

For example, a jar comprising a jar assembly and a lid assembly is disclosed. The jar assembly includes an aluminum base and a first aluminum inner cup provided within a first cavity defined within the aluminum base. An outer thread is provided about an exterior surface of the aluminum base. The lid assembly includes an outer cap and a hoop provided on an interior surface of a cylindrical sidewall of the outer cap, wherein the hoop is a strip of material having opposite first and second ends, wherein the strip of material is formed into a hoop/ring structure with the first and second ends engaging each other, and then bonded to the interior surface of the cylindrical sidewall of the outer cap. An inner thread mateable with the outer thread is provided about an interior surface of the hoop. The lid assembly may also include a liner provided on an interior surface of a top sidewall of the outer cap for forming a seal with a top rim of the jar assembly.

A method of manufacturing jars of the present disclosure can comprise providing a strip of material having opposite ends, and then rolling or forming the strip of material such that the opposite ends engage each other and such that the strip of material defines a hoop/ring structure. The method may include bonding/adhering the hoop to the interior surface of the cylindrical sidewall of the outer cap. The method may further include bonding/adhering the liner to the interior surface of the top sidewall of the outer cap. The method may further include coating the interior surfaces of the jar assembly and/or anodizing an exterior surface of the jar.

A lid assembly is provided herein. The lid assembly may include an outer lid and an inner lid provided in an interior cavity of the outer lid. The inner lid may include a first portion and a second portion having smaller diameter with the first portion such that the cylindrical sidewall of the first portion contacts the cylindrical sidewall of the outer lid. The second portion of the inner lid may have a top wall that contacts the top wall of the outer lid, and the first portion of the inner lid may have an annular shaped upper wall that is spaced from the top wall of the outer wall.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

FIG. 13 is a top view of the lid assembly of FIG. 12, when assembled together.

FIG. 14 is a side cross-sectional view of the lid assembly of FIG. 13, along section line A-A in FIG. 13.

DETAILED DESCRIPTION

The present disclosure is related to jars and containers and, more particularly, to the manufacture of readily recyclable jars and containers.

Currently, standard construction for jars for consumer products for household use, e.g. makeup jars for creams, powders and emulsion-type products, have a PET plastic or a glass bottom jar portion and a screw-on plastic lid, or a plastic lid with metal shroud. In order to recycle these commonly used jars, the consumer must unscrew the jar and can sometimes place the jar in a PET or glass bin in order for the jar to be recycled, but the lid remains difficult to recycle.

Figure 1:
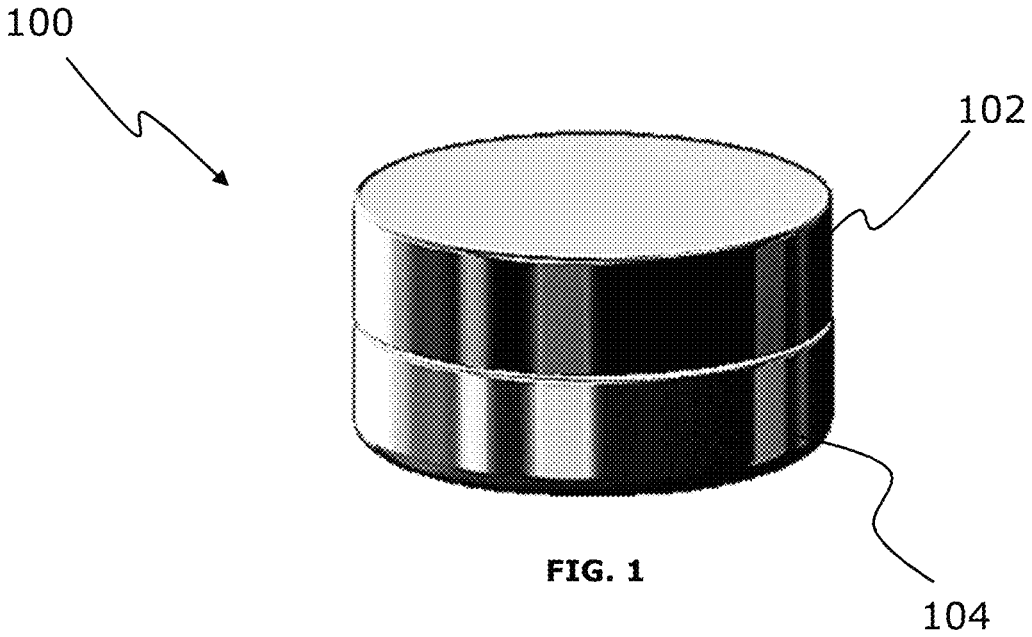
FIG. 1 is a perspective view of a jar according to one or more embodiments of the present disclosure.

FIG. 1 illustrates a jar 100 that is easily recyclable, according to one or more embodiments of the present disclosure. In the illustrated example, the illustrated jar 100 is cylindrically shaped. However, the jar 100 may have other geometries without departing from the present disclosure.

The jar 100 includes a lid assembly 102 and a jar assembly 104 (or base assembly 104). The lid assembly 102 may be fastened or secured to the jar assembly 104. However, the lid assembly 102 may be detached from the jar assembly 104 to access an internal cavity 500 (FIG. 5) of the jar 100. Thus, as described below, the lid assembly 102 attaches to the jar assembly 104 via an attachment means (e.g., mating threads). The attachment means permits a user to selective attach or detach the lid assembly 102 from the jar assembly 104. However, as illustrated, the attachment means are hidden from view when the lid assembly 102 is assembled on the jar assembly 104, which provides the jar 100 an aesthetically pleasing appearance.

Figure 2:
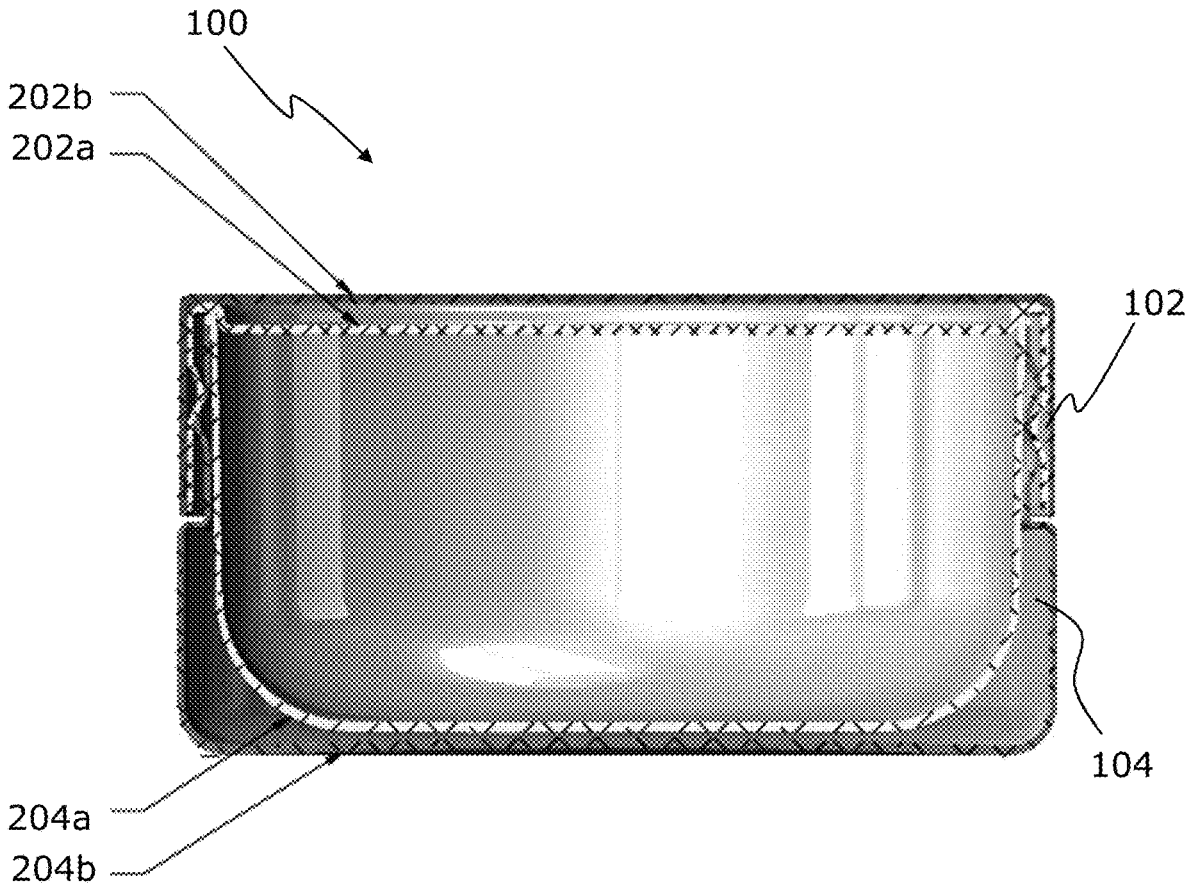
FIG. 2 is a sectional side view of the jar of FIG. 1 with the lid secured.

FIG. 2 illustrates a cross sectional view of the jar 100 of FIG. 1. In the illustrated example, the lid assembly 102 and the jar assembly 104 are each a two-piece design. Thus, the lid assembly 102 includes an inner cap 202*a* and an outer cap 202*b*, and the jar assembly 104 includes an inner cup 204*a* and an outer cup 204*b*. Also, as mentioned above, the lid assembly 102 and the jar assembly 104 may be attachable via mating threads. Thus, in the illustrated example, the mating threads are provided on an inner diameter of the lid assembly 102 and on a corresponding outer diameter of the jar assembly 104 over which the lid assembly 102 is disposed. In this manner, the threads are hidden from view when lid assembly 102 and the jar assembly 104 are assembled together.

Figure 3:
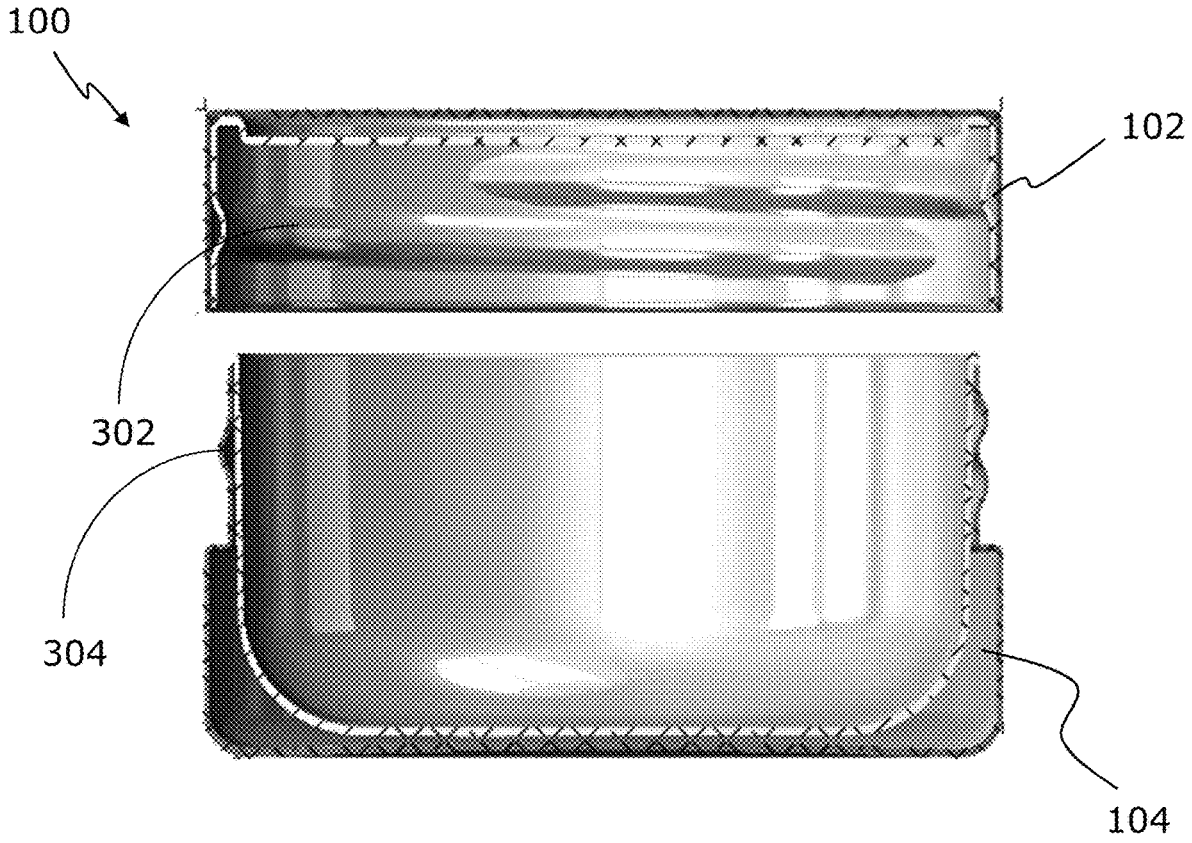
FIG. 3 is a sectional side view of the jar of FIG. 1 with the lid separated from the jar.

FIG. 3 illustrates a cross sectional view of the jar 100 of FIG. 1 when unassembled. As illustrated, a thread 302 is provided in the inner diameter of the lid assembly 102 and a corresponding thread 304 is provided on the outer diameter of the jar assembly 104. Here, the thread 302 is provided on the inner cap 202*a*, winding around an interior sidewall thereof, and covered by the outer cap 202*b* such that the thread 302 is not visible unless viewing an internal cavity of the lid assembly 102 when unattached from the jar assembly 104. Also, the corresponding thread 304 of the jar assembly 104 is provided on the outer cup 204*b*, winding around an outer sidewall thereof, to mesh with the thread 302 of the lid assembly 102. The corresponding thread 304 of the jar assembly 104 is thus visible and exposed when the jar 100 is unassembled, but hidden from view when assembled with the lid assembly 102 is secured over the jar assembly 104. In some embodiments, the jar 100 may include a secondary closure mechanism in addition to, or instead of, the corresponding threads 302, 304, for example, a magnetic closure and or interference fit closure for securing the lid assembly 102 and the jar assembly 104 together.

The jar 100 may be made entirely (or predominantly) from a metallic material; however, non-metallic materials may be utilized. In some examples, the lid assembly 102 and the jar assembly 204 are made of the same material, whereas in other examples, they are made from one or more dissimilar materials. In one example, the inner cap 202*a* and the outer cap 202*b* of the lid assembly 102 and the inner cup 204*a* and the outer cup 204*b* of the jar assembly 104 are all comprised of aluminum. Fabricating the jar 100 from (predominantly) the same metallic material will improve its recyclability. Also, fabricating the jar 100 from predominantly a metallic material provides it with a premium metallic appearance, thereby further enhancing its ability to be utilized in applications where aesthetics are desirable.

The jar 100 may also have some nonmetallic components (e.g., plastic components) and still be recyclable. For example, either or both of the inner cap 202*a* and/or the inner cup 204*a* of the lid assembly 102 and the jar assembly 104, respectively, may be made from a plastic material. In examples where the jar 100 includes one or more plastic components, such plastic components may be installed in a manner permitting the end user to easily remove it before disposal, to enhance recyclability of the jar 100. For example, the inner cup 204*a* of the jar assembly 104 may be a plastic liner that is press fit within the outer cup 204*b* in a manner permitting the end user to easily remove it from the outer cup 204*b* before disposing of the jar assembly 104. In some examples, the jar 100 includes one or more plastic components that need not be removed prior to disposal as such plastic components will be burned up in the metal recycling process. In some examples, the lid assembly 102 includes a gasket to help form a seal when attached on the jar assembly 104. The gasket may be provided on either or both of the lid assembly 102 and the jar assembly 104 to form a seal there-between. In some examples, an additional liner is provided within the inner cap 202*a* and/or inner cup 204*a*, such as a polymeric liner or removable and replaceable liner; and in some examples, a series of liners may be so provided such that they are serially removed after each use to provide a clean surface for a subsequent use.

A coating may be applied to the lid assembly 102 and/or the jar assembly 104. Various types of coating may be utilized, for example, a polymeric coating and/or a ceramic spray, and such coatings may be applied after assembly of the jar 100 or pre-coated materials may be utilized to manufacture the jar 100. In some examples, a coating is applied to interior surfaces 602, 604 (FIG. 6) of the inner cap 202*a* and/or the inner cup 204*a* of the lid assembly 102 and the jar assembly 104, respectively. For example, the inner cap 202*a* and the inner cup 204*a* may be made from aluminum and a polymeric coating applied to their interior surfaces 602, 604 defining the interior cavity of the jar 100. Here, the polymeric coating may be applied after assembly of the jar 100 or pre-coated components may be utilized to form the inner cap 202*a* and the inner cup 204*a*. The coating may be an FDA-approved polymeric coating, e.g., epoxy powdercoat.

Where metallic materials are utilized to form the jar 100, they may be anodized, for example, external surfaces 502, 504 (FIG. 5) of the lid assembly 102 and the jar assembly 104. Thus, the external surfaces 502, 504 of the outer cap 202*b* and the outer cup 204*b* may be anodized. This will provide an aesthetically pleasing and premium appearance. Also, the internal surfaces 602, 604 of the jar 100 defining the internal cavity 500 may be anodized, or at least some portion of either or both of the internal surfaces 502, 504 of the jar 100 defining the internal cavity 500 may be anodized. For example, the internal surfaces 602, 604 of the inner cap 202*a* and the inner cup 204*a* may be anodized regardless of whether the external surfaces 502, 504 are anodized. Also, at least some portion of either or both of the external surfaces 502, 504 of the jar 100 defining the internal cavity 500 may be anodized Various techniques may be utilized to form the inner cap 202*a* and the outer cap 202*b* of the lid assembly 102 and the inner cup 204*a* and the outer cup 204*b* of the jar assembly 104. For example, any or all may be formed via a deep drawing, impact extrusion, roll forming, eyelet stamping etc.

Figure 4A:
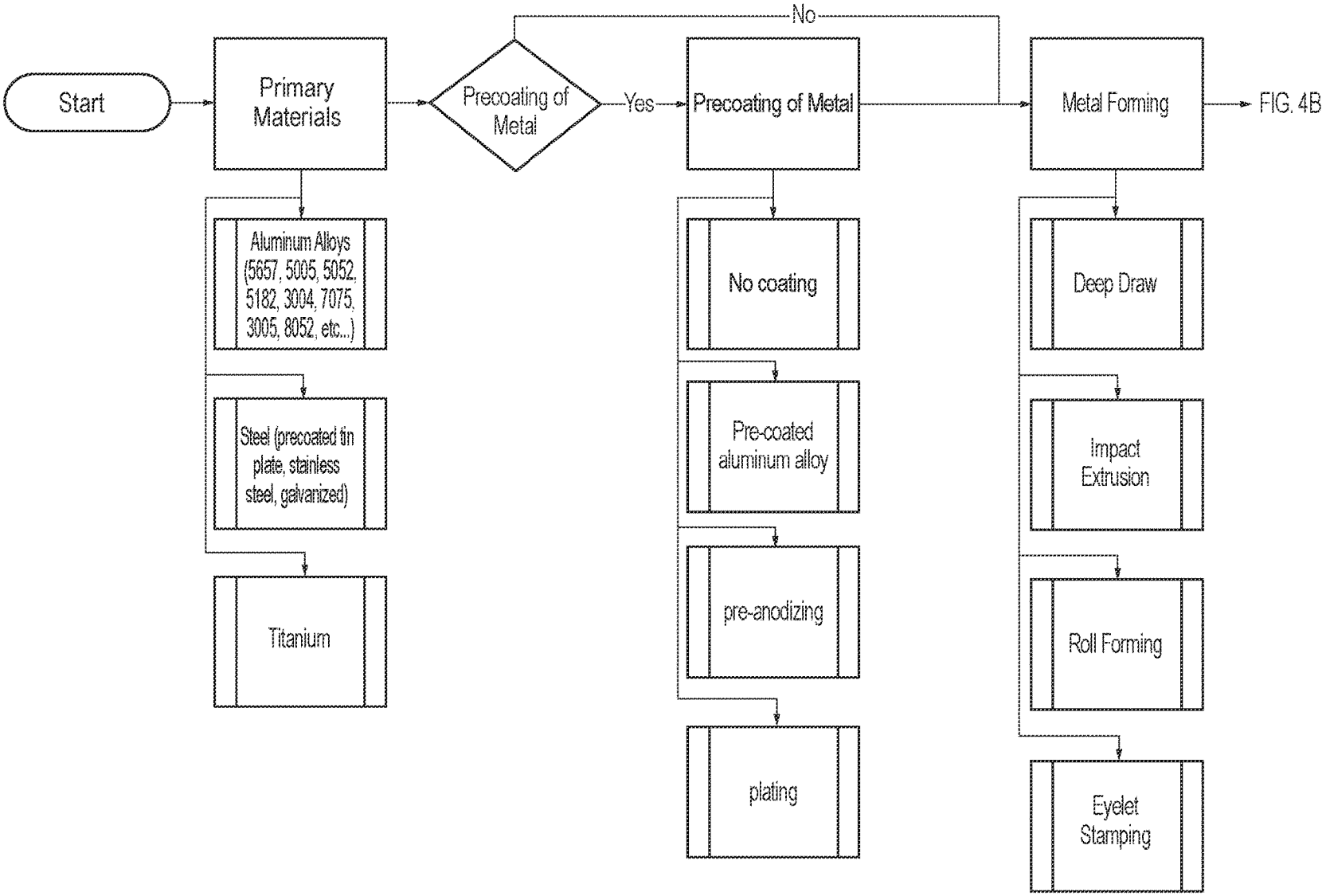
FIG. 4A is the first part of a schematic of a method of constructing jars according to the present disclosure.
Figure 4B:
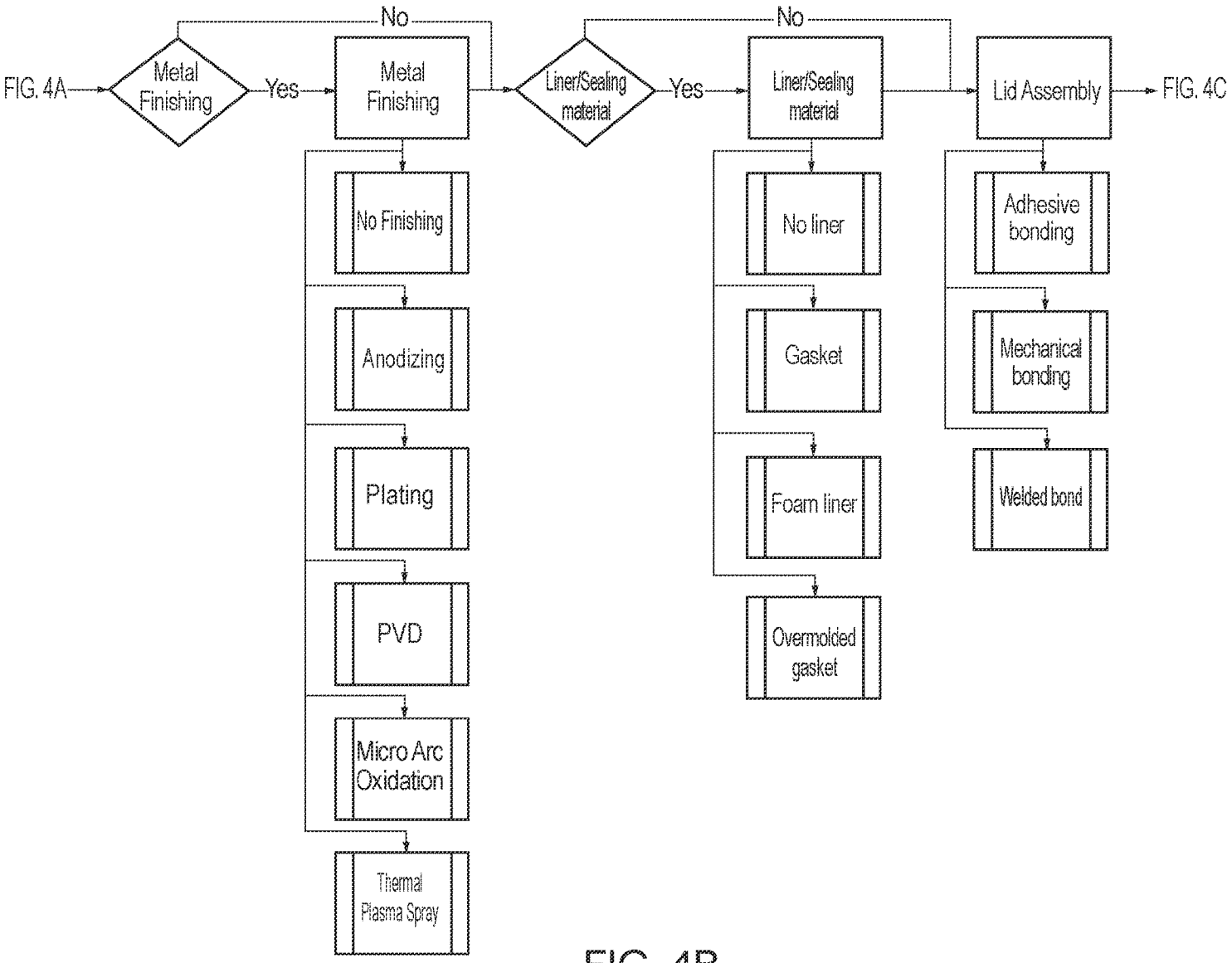
FIG. 4B is the second part of a schematic of a method of constructing jars according to the present disclosure.
Figure 4C:
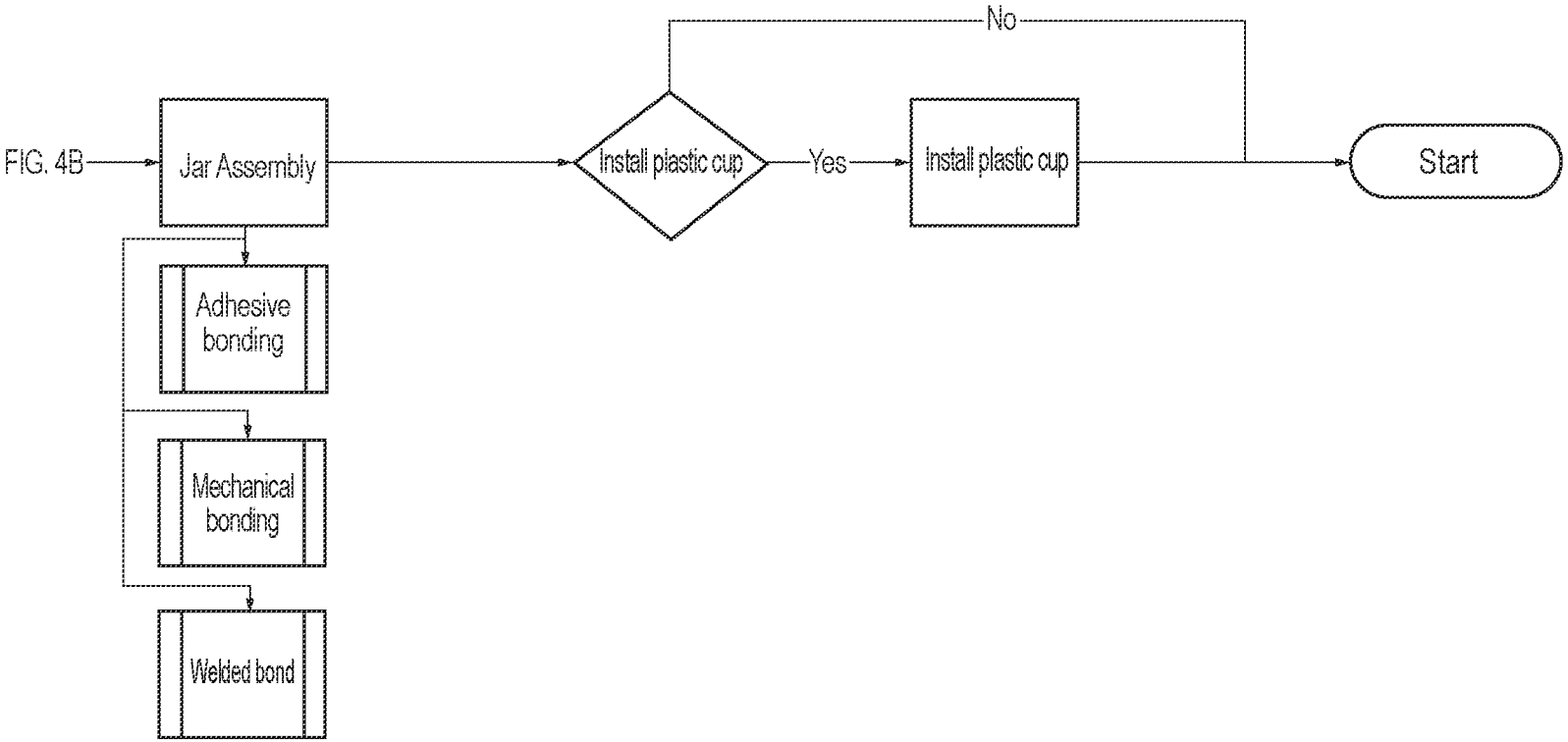
FIG. 4C is the third part of a schematic of a method of constructing jars according to the present disclosure.

FIGS. 4A-4C illustrate a flowchart of an exemplary process that may be utilized to manufacture the jar 100.

As shown in FIG. 4A, the manufacturing process begins with providing a primary material, or selecting a primary material. The primary material may be aluminum or aluminum alloys, e.g., 5657, 5005, 5052, 5182, 3004, 7075, 3005, 8052, and others known to one skilled in the art; steel, such as pre-coated tin plate, stainless steel or galvanized steel; titanium, or other metal materials adjudged suitable for use by one skilled in the art.

Optionally, the primary metal material may be pre-coated, such a by pre-coating the aluminum alloy, pre-anodizing the metal, or plating. Accordingly, the manufacturing process may include an optional step of precoating the selected material. In some embodiments, the selected material has no precoating. However, Aluminum alloys may be pre-coated with an inorganic barrier-type corrosion inhibitor, e.g., a composition comprising clay particles. In some embodiments, the selected material is pre-anodized. Pre-anodizing the material involves an electrochemical process that converts the metal surface into a decorative, durable, corrosion-resistant, anodic oxide finish. A typical chemical treatment process may involve removing dirt and oils, such as by treatment with an inhibited acid or alkaline cleaner, deoxidizing the material in strong acidic solution to remove natural oxides or heat-treat scale, and chemical etching or brightening. Strong acids or bases may be used to etch the material in order to provide a uniform, matte finish. Brightening, also known as micro-leveling or micro-smoothing, may be achieved by either chemical or electrochemical means, as would be known by one skilled in the art. Alternatively, the selected material may be plated, such as to increase corrosion protection, provide greater wear resistance or to enhance the appearance of a product. Electroplating or an autocatalytic reaction may be used. The plating material may be any commonly known in the art, such as zinc, tin, magnesium, silicon or other metals or metalloids.

Thereafter, the manufacturing process includes a metal forming step. The metal is formed to make the jar assembly and lid assembly, such as by deep draw, impact extrusion, roll forming or eyelet stamping. Deep drawing involves a hydraulic or mechanical press pushing the metal sheet via an appropriately shaped punch into a matching die. Impact extrusion utilizes a punch to press a slug at high velocity and force into the appropriately shaped die or mold. Roll forming passes the metal through a continuous bending operation to bend the metal into the desired shape of a jar assembly or lid.

FIG. 4B is a continuation of an exemplary manufacturing process, and it includes an optional step of metal finishing. The metal may be finished via anodizing, plating, physical vapor deposition (PVD), micro arc oxidation, and/or thermal plasma spray.

The jar assembly and lid assembly may optionally comprise a liner material and/or sealing material, by way of non-limiting examples a gasket, foam liner, or overmolded gasket. According, the manufacturing process may further include an optional step of providing a liner and/or seal.

The manufacturing process then includes the step of assembling the lid assembly. The assembly of the lid assembly, or the combining of the inner cap with the outer cap, may be carried out by means of adhesive bonding, mechanical bonding, welded bonding, or other methods known to one skilled in the art.

FIG. 4C further continues the depiction of an exemplary manufacturing process. As shown, the manufacturing process further includes the step of assembling the jar assembly, and this step may be performed before, after, or simultaneously with the step of assembling the lid assembly. The step of assembling the jar assembly be carried out by means of adhesive bonding, mechanical bonding, welded bond, or other methods known to one skilled in the art.

Following the step of assembling the jar assembly, the manufacturing process may include an optional step of installing a cup within the jar assembly. For example, a plastic cup may be installed within the jar assembly. In the illustrated example, the step of installing a cup is provided a final step; however, in other non-illustrated steps, the jar may be further subject to final decorating or design steps, including painting, etching, branding, adding graphics or decals, or providing other indicia as may be desirable for the final end use application.

Figure 5:
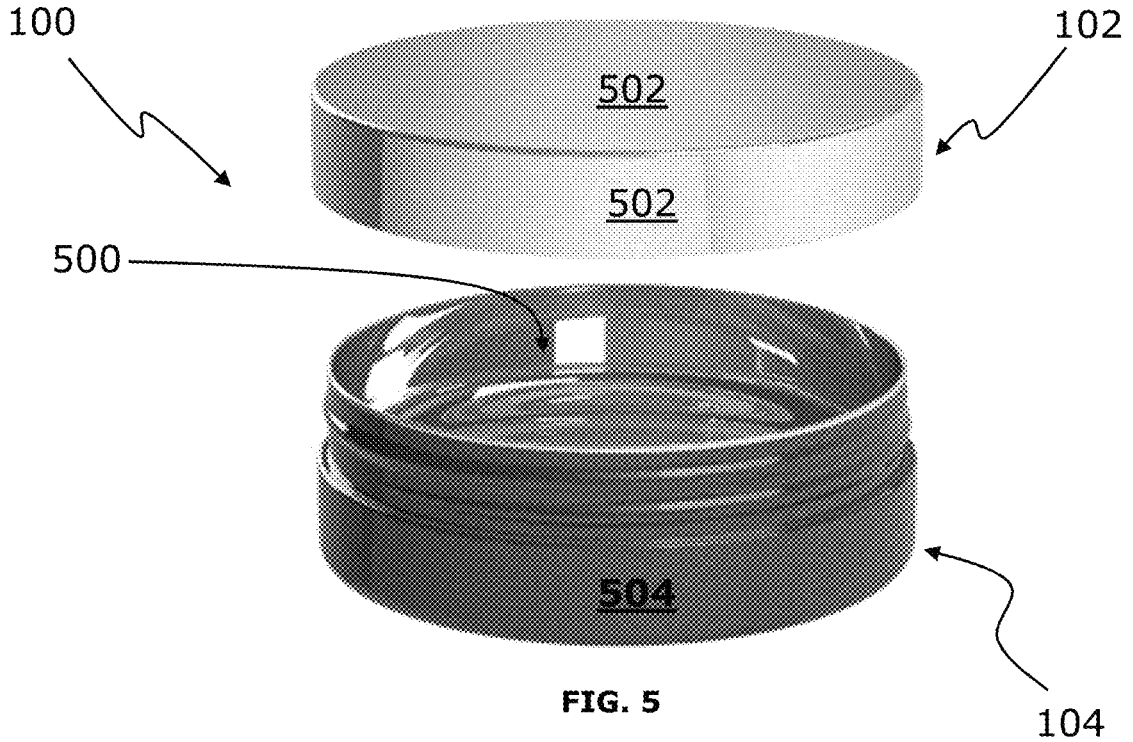
FIG. 5 is a perspective view of a jar assembly with the lid separated from the jar.
Figure 6:
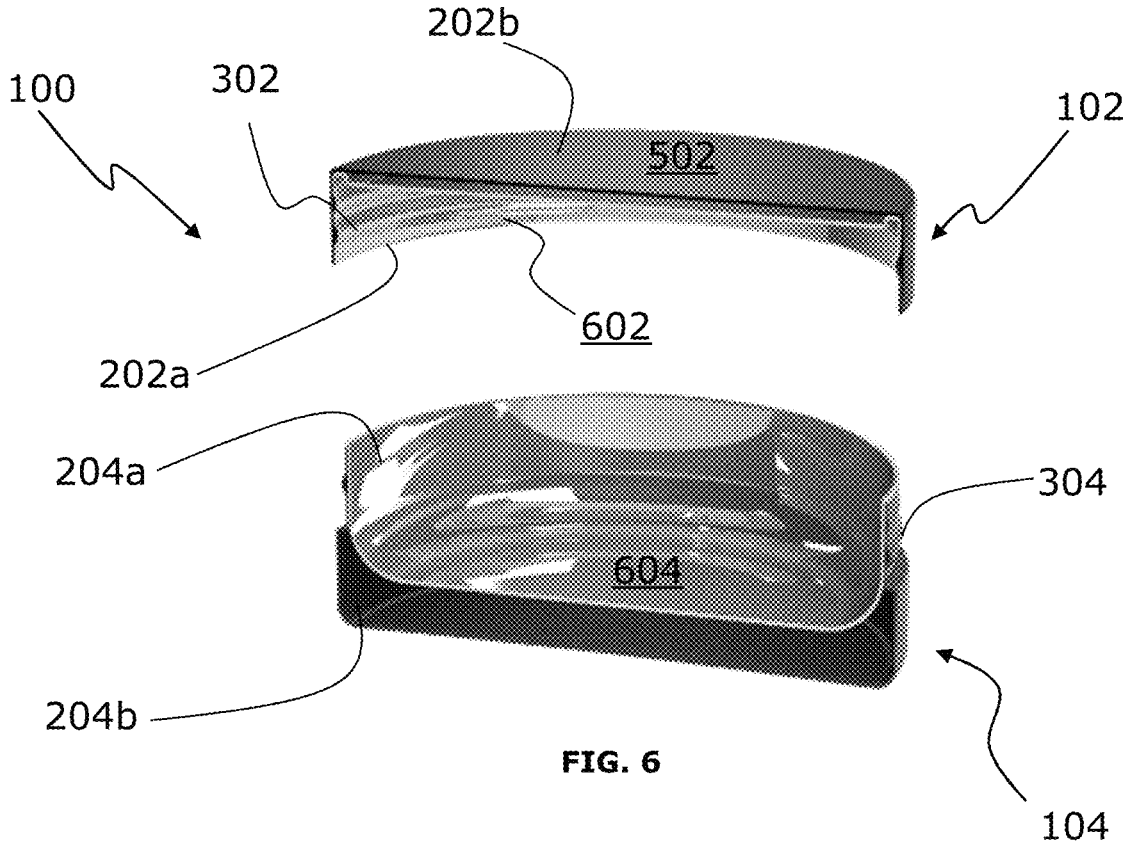
FIG. 6 is a sectional view of the jar of FIG. 5.

FIG. 5 shows the result of the exemplary manufacturing process, namely a perspective view of a jar formed via this process with the lid assembly elevated over the jar assembly. FIG. 6 is a sectional side view of the jar of FIG. 5.

Figure 7:
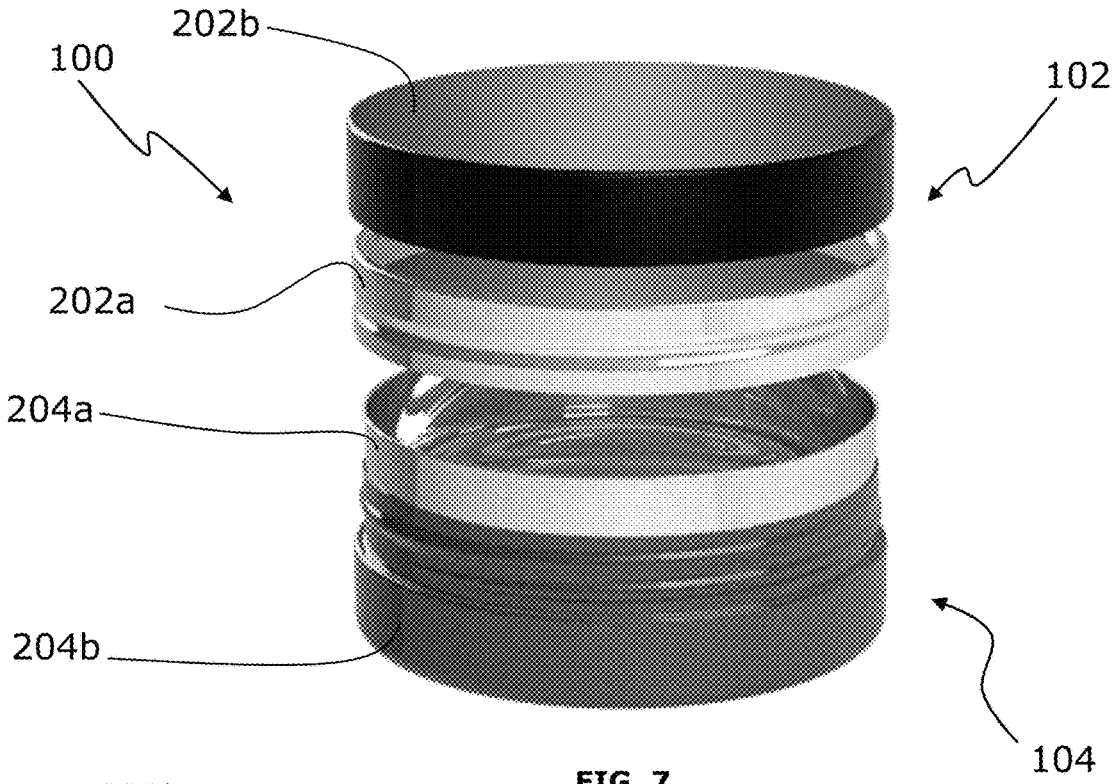
FIG. 7 is a perspective view of a jar of the present disclosure with the inner cups separated from the base and lid.
Figure 8:
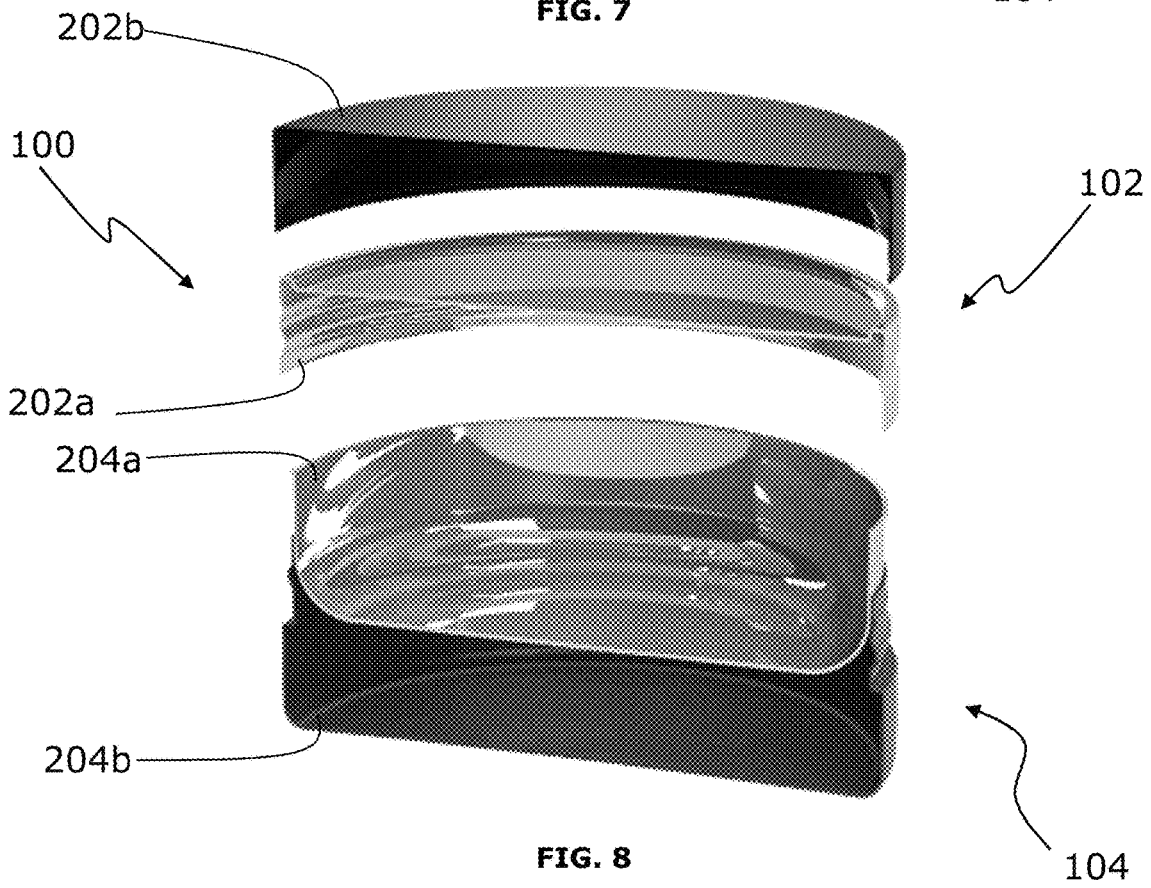
FIG. 8 is a sectional view of the jar of FIG. 7.

FIG. 7 depicts the jar assembly and lid assembly with the inner cup and inner cap separated from the outer cap and base of the jar. FIG. 8 depicts a sectional side view of the jar of FIG. 5.

Figure 9:
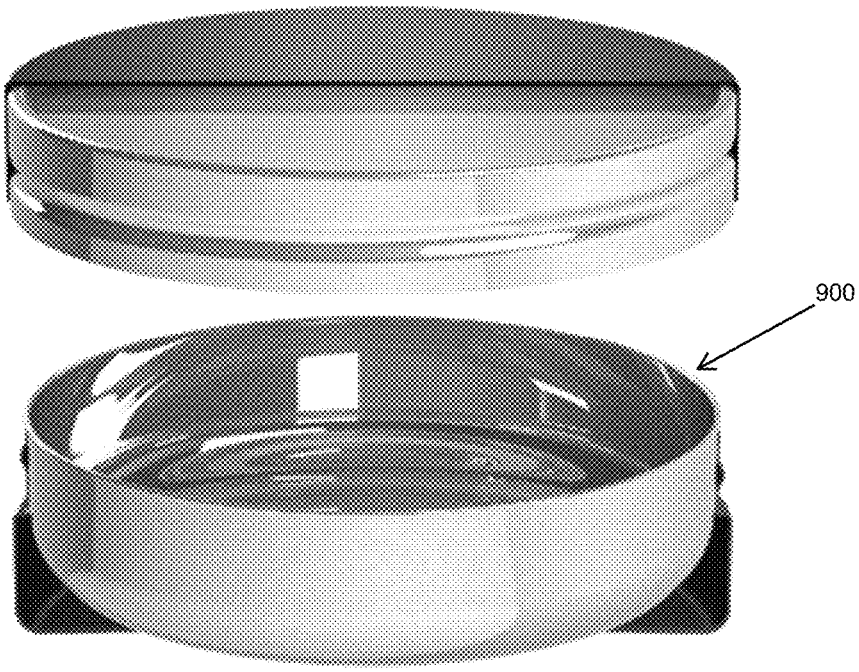
FIG. 9 is a partial sectional view of the jar of FIG. 7, showing the base and lid cut along a centerline, while the inner cups are whole.

FIG. 9 depicts the jar assembly and lid assembly with the outer cap and base in a cross-section along a midline of the cylindrical jar. The inner cup and inner cap are not sectioned, but are instead complete, thus depicting out the inner portions look absent the outer portions of the lid assembly and jar assembly.

Figure 10:
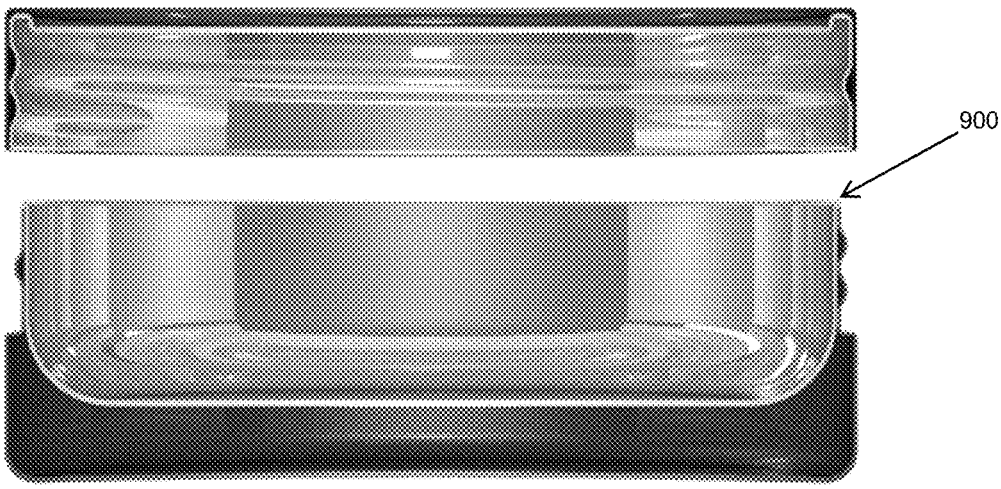
FIG. 10 is a sectional view of one embodiment of a jar of the present disclosure.
Figure 11:
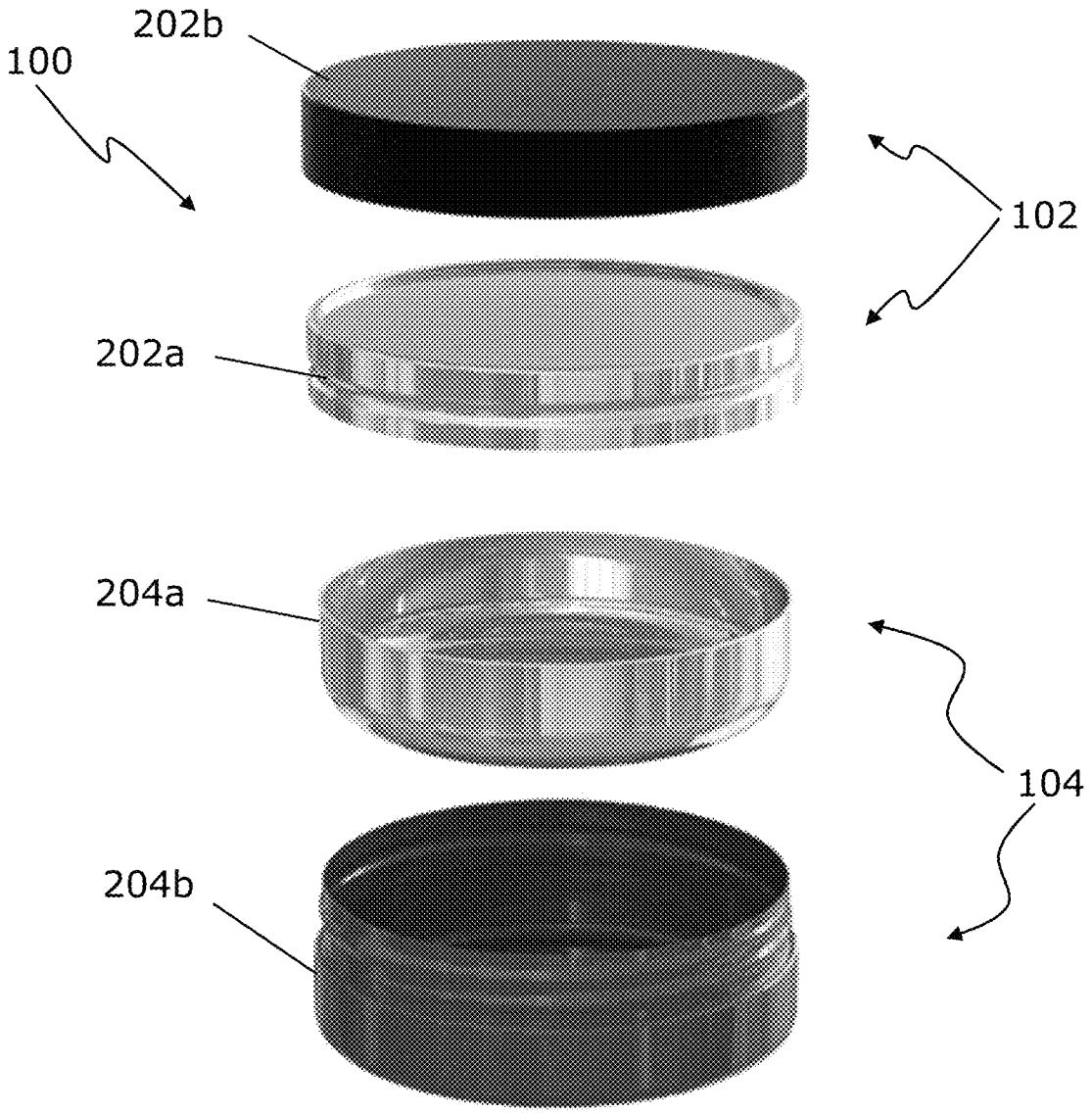
FIG. 11 is an exploded view of one embodiment of a jar of the present disclosure.

FIG. 10 is a sectional side view of a jar of the present disclosure with the lid assembly elevated over the jar assembly. Finally, FIG. 11 depicts an exploded view, with the inner caps 202*a*, 204*a* removed from the outer portions 204*a*, 204*b* of the jar assembly 104 and lid assembly 102.

FIGS. 12 to 20 illustrate an alternate embodiment of a lid assembly 1200, according to one or more embodiments of the present disclosure. The lid assembly 1200 may be utilized in combination with the jar assembly 104 (or the base assembly 104) described above and, when the lid assembly 1200 is provided on the jar assembly 104, the combination of the jar assembly 104 and the lid assembly 1200 defines a jar that may have similar functionality as the jar 100 detailed above. Thus, the lid assembly 1200 may be fastened or secured to the jar assembly 104, and the lid assembly 1200 may be detached from the jar assembly 104 to access an internal cavity of the jar defined by the combination of the jar assembly 104 and the lid assembly 1200.

Figure 12:
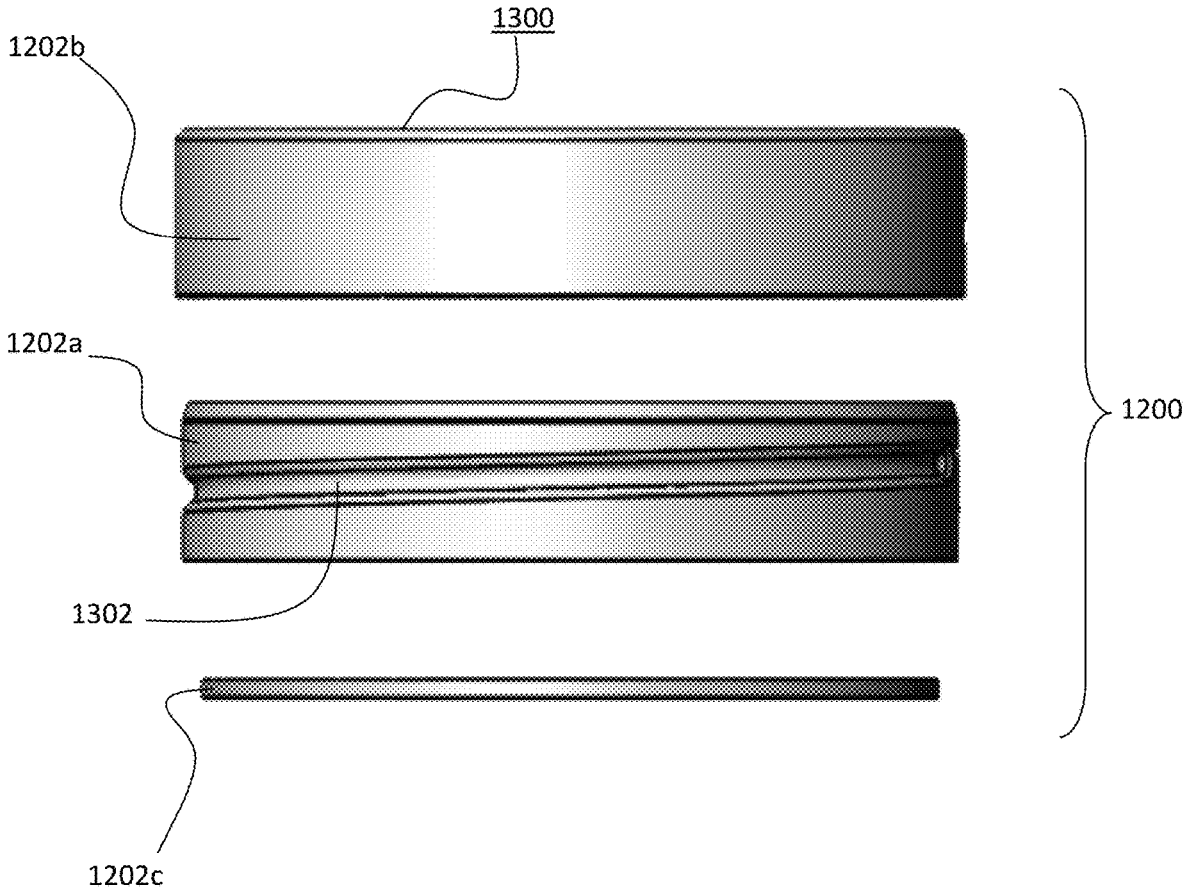
FIG. 12 illustrates an exploded view of an alternate lid assembly utilizable with the jar assembly described here, according to one or more embodiments of the present disclosure.
Figure 15:
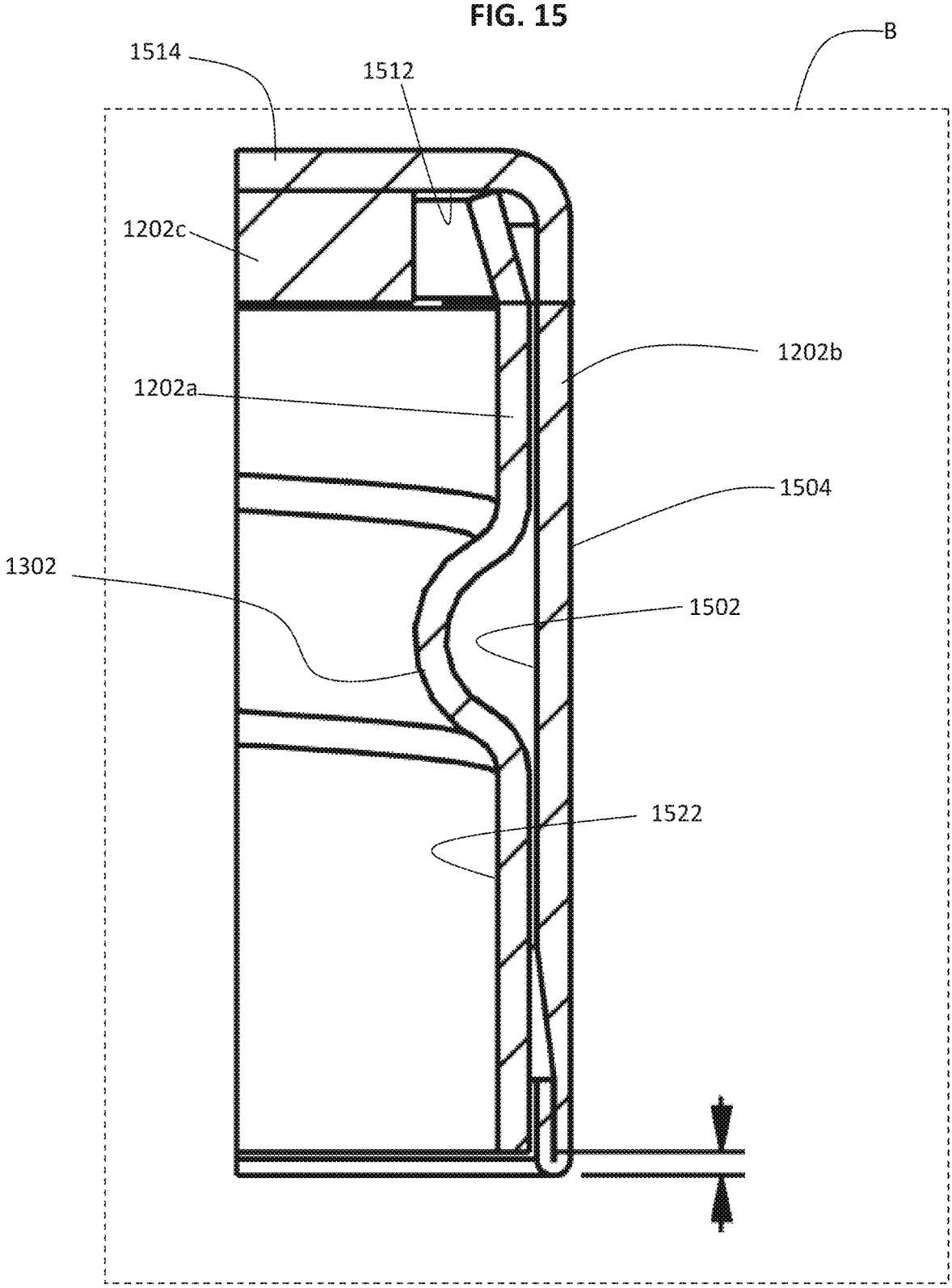
FIG. 15 is a close-up, detailed, view of the lid assembly at detailed portion B in FIG. 14.
Figure 16:
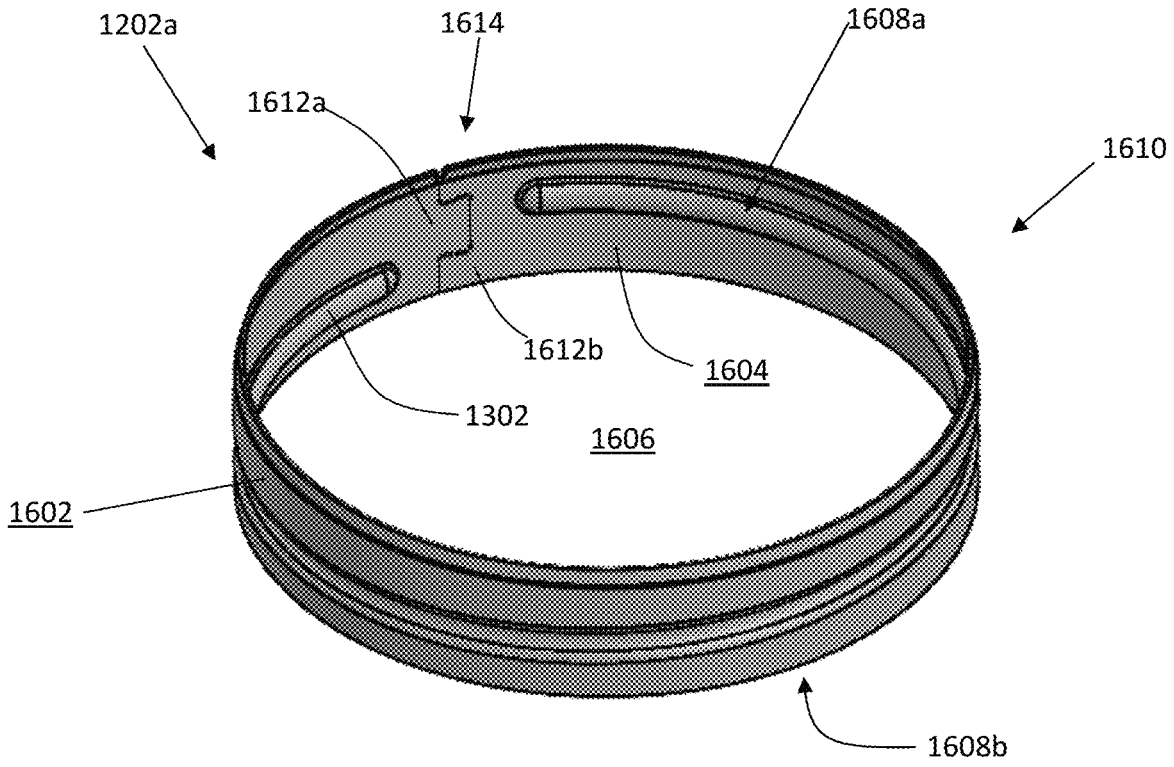
FIG. 16 is an isometric view of the hoop utilized in FIGS. 13-15.
Figure 17:
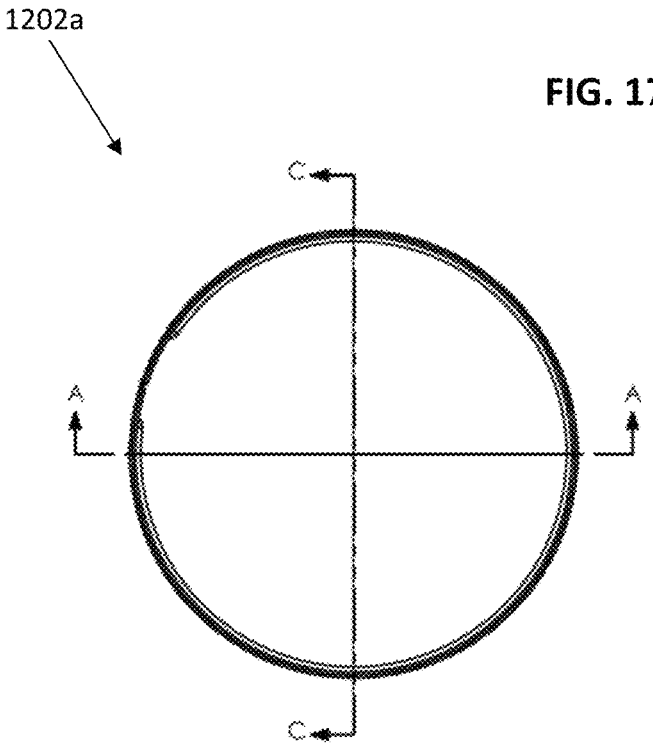
FIG. 17 is a top view of the hoop of FIG. 16.
Figure 18:
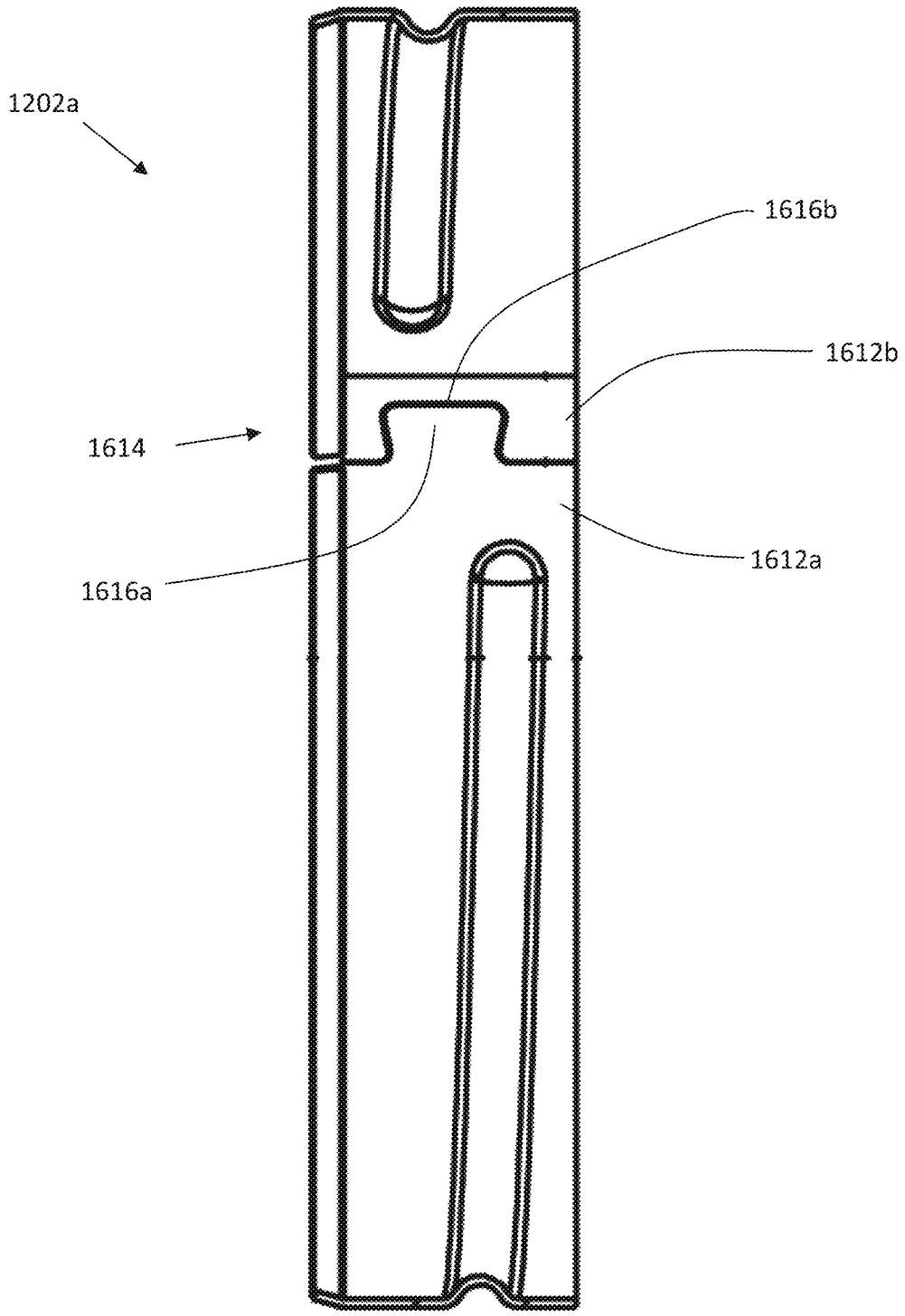
FIG. 18 is a cross sectional view of the hoop along section line C-C in FIG. 17.
Figure 19:
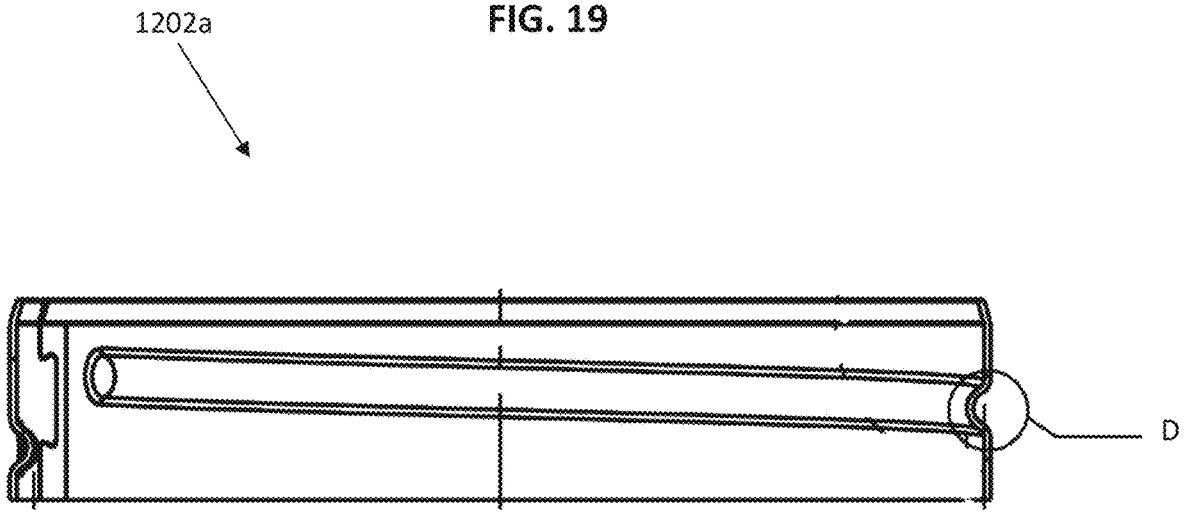
FIG. 19 is a cross sectional view of the hoop along section line A-A in FIG. 17.
Figure 20:
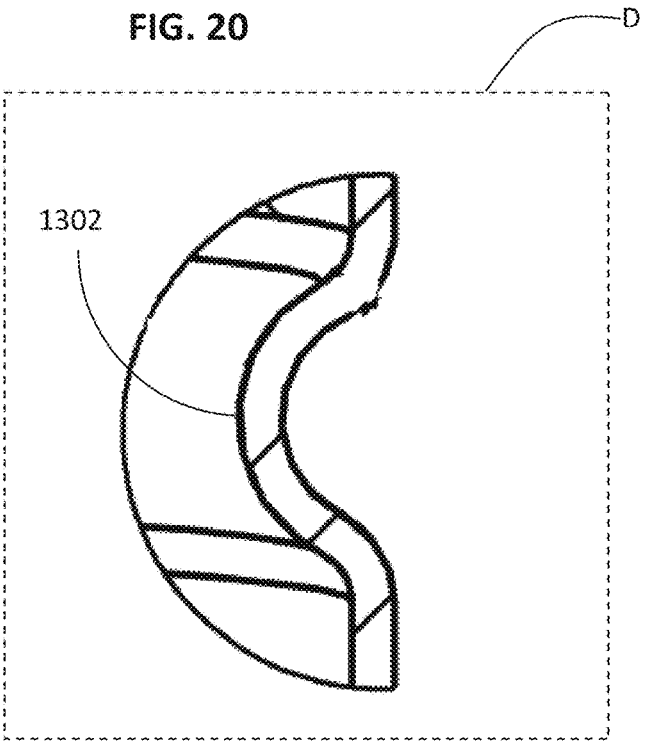
FIG. 20 is a detailed cross-section view of detail D in FIG. 19.

FIG. 12 illustrates an exploded view of the lid assembly 1200. FIG. 13 illustrates a top view of the lid assembly 1200 of FIG. 12, when assembled together. In particular, FIG. 13 depicts a top outer surface 1300 of the lid assembly 1200, with the top outer surface 1300 being part of the outer cap 1202*b*. FIG. 14 illustrates a side cross-sectional view of the lid assembly 1200 of FIG. 13, along section line A-A in FIG. 13, and FIG. 15 illustrates a detailed cross-section view of detail B in FIG. 14. Further, FIG. 16 and FIG. 17 depict an isometric view and a top view, respectively, of the hoop 1202*a*. Further, FIG. 18 depicts a cross sectional view of the hoop 1202 along section line C-C in FIG. 17, FIG. 19 depicts a cross sectional view of the hoop 1202 along section line A-A in FIG. 17, and FIG. 20 illustrates a detailed cross-section view of detail D in FIG. 19.

In the illustrated example, the lid assembly 1200 is a three-piece design. As shown, the lid assembly 1200 includes an inner hoop 1202*a*, an outer cap 1202*b*, and a liner 1202*c*. The outer cap 1202*b* defines an internal cavity within which the inner hoop 1202*a* and the liner 1202*c* may be provided. The lid assembly 1200, when assembled together, and the jar assembly 104 may be attachable via mating threads. In the illustrated example, a thread 1302 of the lid assembly 1200 mates with the corresponding thread 304 of the jar assembly 104 (which is provided on the outer diameter of the outer cup 204*b* of the jar assembly 104) when the lid assembly 1200 is provided on the jar assembly 104. Here, the thread 1302 is provided on the hoop 1202*a*, winding around an interior sidewall thereof, and covered by the outer cap 1202*b* such that the thread 1302 is not visible unless viewing an internal cavity of the lid assembly 1200 when unattached from the jar assembly 104. The corresponding thread 304 of the jar assembly 104 is thus visible and exposed when the jar is unassembled, but hidden from view when assembled with the lid assembly 1200 is secured over the jar assembly 104. In some embodiments, a secondary closure mechanism may be utilized, in addition to, or instead of, the corresponding threads 1302, 304, for example, a magnetic closure and or interference fit closure for securing the lid assembly 1200 and the jar assembly 104 together.

As shown in at least FIG. 16, the hoop 1202*a* is a ring like structure. Here, the hoop 1202*a* includes an outer sidewall 1602 and an inner sidewall 1604 opposite the outer sidewall 1602. Also, the thread 1302 extends from and into the inner sidewall 1604 to engage the corresponding thread 304 of the jar assembly 104. Also, the hoop 1202*a* defines a bore 1606, which extends through the hoop 1202*a* between an open upper end 1608*a* and an open lower end 1608*b* opposite the upper open end 1608*a*.

The hoop 1202*a* may be formed from a single strip of material 1610 having a first end 1612*a* and a second end 1612*b* opposite the first end 1612*a*. The strip 1610 may be rolled or formed into the rim/hoop like structure, and then first end 1612*a* and the second end 1612*b* of the strip 1610 may be joined together at a joint 1614. In the illustrated embodiment, the joint 1614 is a dove tail joint, with the first end 1612*a* including a tail 1616*a* (FIG. 18) of the dovetail joint and the second end 1612*b* including a socket 1616*b* (FIG. 18) of the dovetail joint into which the tail 1616*a* may be provided to secure the first end 1612*a* and the second end 1612*b* together.

The liner 1202*c* may function as a seal when the lid assembly 1200 is screwed onto the jar assembly 104. In embodiments, the liner 1202*c* may be a piece of soft compressible material, such as polyethylene (PE) foam or paper pulp. Where utilized, the liner 1202*c* is used to form a seal between the lid assembly 1200 and the jar assembly 104. For example, when the lid assembly 1200 is screwed onto the jar assembly 104, an upper rim 900 (see FIGS. 9-10) of the jar assembly 104 may engage the liner 1202*c* to thereby form a seal between the lid assembly 1200 and the jar assembly 104.

To assemble the lid assembly 1200, the strip of material 1610 is formed into the ring like shape and the ends 1612*a*, 1612*b* are attached or joined together at the joint 1614 such that the strip of material 1610 defines the hoop 1202*a*. Then, adhesive is applied to an inner surface 1502 of a cylindrical sidewall portion 1504 of the outer cap 1202*b* (FIG. 15), and the hoop 1202*a* is adhered/bonded within a cavity defined by the outer cap 1202*b* and, in particular the hoop 1202*a* being adhered/bonded to the inner surface 1502 the outer cap 1202*b*, with the surface of the outer sidewall 1602 in contact with the inner surface 1502 the outer cap 1202*b*. Also, adhesive is applied to an inner surface 1512 of a top sidewall portion 1514 of the outer cap 1202*b* (FIG. 15), and the liner 1202*c* is adhered to the inner surface 1512 the outer cap 1202*b*, with an upper surface of the liner 1202*c* in contact with the inner surface 1512 the outer cap 1202*b*, and with the cylindrical sidewall portion 1504 extending downward from the top sidewall portion 1514 of the outer cap 1202*b* and with the inner surface 1502 of the cylindrical sidewall portion 1504 and the inner surface 1512 of the top sidewall portion 1514 of the outer cap 1202*b* together defining the inner cavity of the outer cap 1202*b* within which the hoop 1202*a* and the liner 1202*c* may be provided. Assembling the lid assembly 1200 in this manner is beneficial in that it lower material costs and forming costs than as compared to the lid assembly 102.

Also disclosed herein is a method of forming a jar including the lid assembly 1200. The method may include a step of forming the lid assembly 1200, which may include a step of providing the outer cap 1202*b*, which may further include forming the outer cap 1202, for example, via deep drawing, impact extrusion, roll forming, eyelet stamping etc. The step of forming the lid assembly 1200 may include providing the strip of material 1610 and forming the strip of material 1610 into the hoop 1202*a* (or the step of forming the hoop 1202*a* from the strip of material 1610), for example, but rolling the strip of material 1610 into the hoop 1202*a*. The method may then include a step adhering or bonding the hoop 1202*a* to the inner surface 1502 of the cylindrical sidewall portion 1504 of the outer cap 1202*b*. The method may also include a step adhering or bonding the liner 1202*c* to the inner surface 1512 the outer cap 1202*b*, and this step may be performed before, after, or substantially simultaneously as the step of bonding the hoop 1202*a* to the outer cap 1202*b*. In embodiments, the outer cap 1202*b* is formed via deep drawing and, in such embodiments, the aluminum base and the first aluminum inner cup of the jar assembly 104 may be formed via the same or different method. In embodiments, the outer cap 1202*b* is formed via impact extrusion and, in such embodiments, the aluminum base and the first aluminum inner cup of the jar assembly 104 may be formed via the same or different method.

The hoop 1202*a* and the outer cap 1202*b* may be formed of various materials. In embodiments, the hoop 1202*a* and the outer cap 1202*b* are each aluminum. In embodiments, the hoop 1202*a* and/or the outer cap 1202*b* are anodized. In embodiments, an FDA-approved polymeric coating is applied to the inner surface 1512 of the top sidewall portion 1514 and/or to an inner surface 1522 (FIG. 15) of the hoop 1202*a*.

Figure 21:
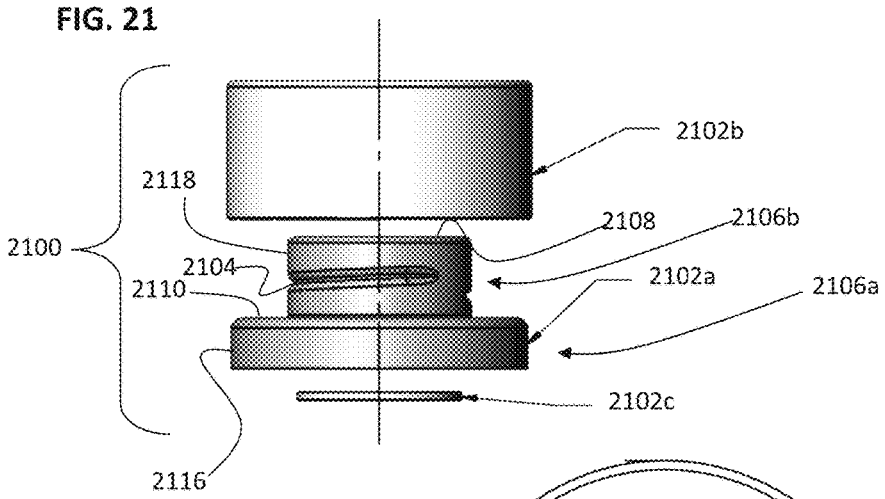
FIG. 21 illustrates an exploded view of an alternate lid assembly utilizable with the jar assembly described here, according to one or more embodiments of the present disclosure.
Figure 22:
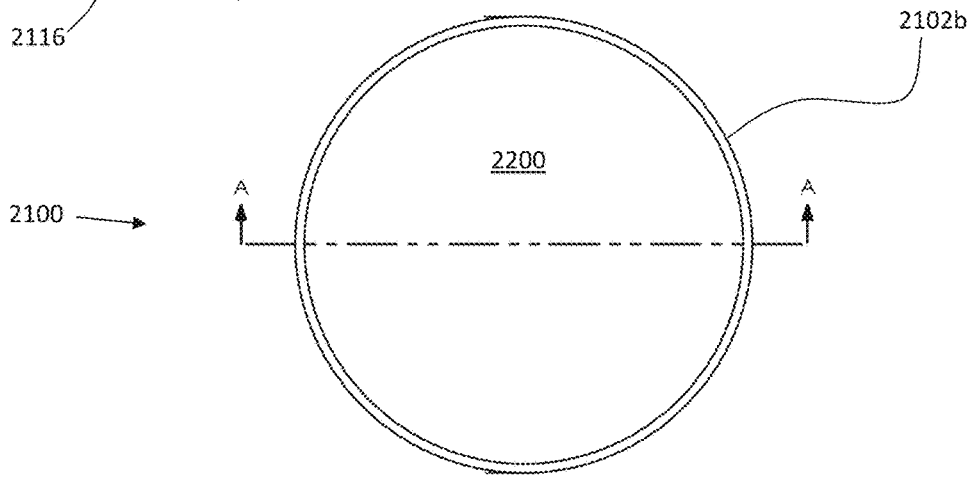
FIG. 22 is a top view of the lid assembly of FIG. 21, when assembled together.
Figure 23:
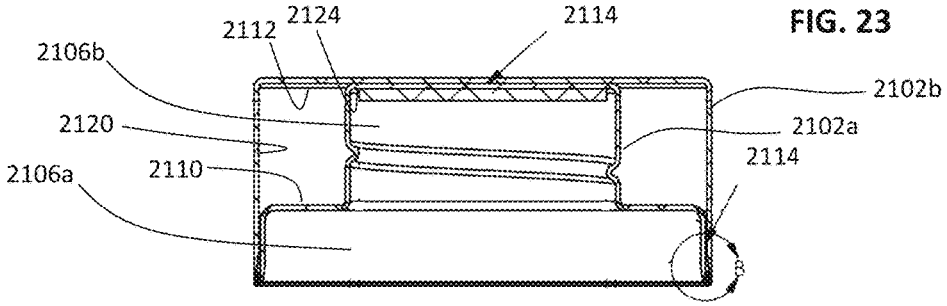
FIG. 23 is a side cross-sectional view of the lid assembly of FIG. 22, along section line A-A in FIG. 22.
Figure 24:
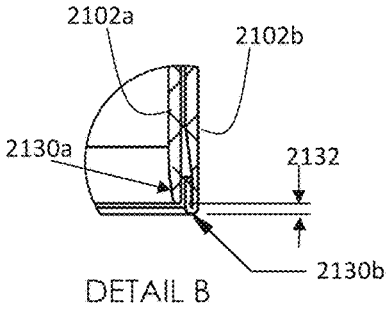
FIG. 24 is a close-up, detailed, view of the lid assembly at detailed portion B in FIG. 23.

FIGS. 21 to 24 illustrate an alternate embodiment of a lid assembly 2100, according to one or more embodiments of the present disclosure. FIG. 21 illustrates an exploded view of the lid assembly 2100. FIG. 22 illustrates a top view of the lid assembly 2100 of FIG. 21, when assembled together. In particular, FIG. 22 depicts a top outer surface 2200 of the lid assembly 2100, with the top outer surface 2200 being part of the outer cap 2102*b*. FIG. 23 illustrates a side cross-sectional view of the lid assembly 2100 of FIG. 22, along section line A-A in FIG. 22, and FIG. 24 illustrates a detailed cross-section view of detail B in FIG. 23.

In the illustrated example, the lid assembly 2100 is a three-piece design. As shown, the lid assembly 2100 includes an inner lid 2102*a*, an outer cap 2102*b*, and a seal 2102*c*. The inner lid 2102*a* and/or the outer lid 2102*b* may be made from various materials, such as aluminum. In embodiments, exposed surfaces of the inner lid 2102*a* and/or the outer lid 2102*b* includes a coating applied thereto, such an FDA-approved polymeric coating. In embodiments, the coating is an epoxy coating.

The outer cap 2102*b* defines an internal cavity within which the inner lid 2102*a* and the seal 2102*c* may be provided. In the illustrated embodiment, the inner lid 2102*a* also defines an internal cavity within which the seal 2102*c* may be provided. The lid assembly 2100, when assembled together, may be attached to a neck of a jar assembly or container via mating threads. In the illustrated example, a thread 2104 of the lid assembly 2100 mates with the corresponding thread of a jar assembly (which is provided on an outer diameter/surface of the jar assembly) when the lid assembly 2100 is provided on the jar assembly. Here, the thread 2104 is provided on the inner lid 2102*a*, winding around an interior sidewall thereof, and covered by the outer cap 2102*b* such that the thread 2104 is not visible unless viewing an internal cavity of the lid assembly 2100 when unattached from the jar assembly. The corresponding thread of the jar assembly is thus visible and exposed when the jar is unassembled, but hidden from view when assembled with the lid assembly 2100 is secured over the jar assembly. In some embodiments, a secondary closure mechanism may be utilized, in addition to, or instead of, the corresponding threads 2104, for example, a magnetic closure and or interference fit closure for securing the lid assembly 2100 and the jar assembly together.

In the illustrated embodiment, the inner cap 2102*a* includes a first portion 2106*a* and a second portion 2106*b*. The first portion 2106*a* has a first diameter and the second portion 2106*b* has a second diameter that is smaller than the first diameter of the first portion 2106*a*. The inner cap 2102*a* includes an upper surface 2108 which is provided on the second portion 2106*b*. The inner cap 2102*a* also includes an upper facing annular surface 2110 which is provided on the first portion 2106*a* and which surrounds the second portion 2106*b*. When the inner cap 2102*a* is assembled within the outer cap 2102*b*, the upper surface 2108 will contact and abut an inner surface 2112 of the outer cap 2102*b*, and the upper facing annular surface 2110 will be spaced from the inner surface 2112 of the circular top wall of the outer cap 2102*b*. In embodiments, an adhesive 2114 may be utilized to secure the upper surface 2108 to the inner surface 2112.

The inner cap 2102*a* includes a first side surface 2116 defined on the first portion 2106*a* and a second side surface 2118 defined on the second portion 2106*b*. The thread 2104 is provided on the second side surface 2118 of the second portion 2106*b*. When the inner cap 2102*a* is assembled within the outer cap 2102*b*, the thread 2104 will be partially hidden, as it will only be visible when viewing the interior cavity of the inner lid 2102*a*, but otherwise covered and hidden by the outer cap 2102*b*. Also, when the inner cap 2102*a* is assembled within the outer cap 2102*b*, the first side surface 2116 will contact and abut an inner side surface 2120 of the outer cap 2102*b*. In embodiments, the adhesive 2114 may also or instead be utilized to secure the first side surface 2116 to the inner side surface 2120. Because the second diameter of the second portion 2106*b* is smaller than the first diameter of the first portion 2106*a*, the second side surface 2118 is spaced apart from the inner side surface 2120 of the outer cap 2102*b*. The seal 2102*c* may be adhered to an inner surface 2124 of the second portion 2106*b* of the inner lid 2102*a*, wherein the inner surface 2124 is opposite the upper surface 2108. In embodiments, the adhesive 2114 is utilized to secure the seal 2102*c* to the inner lid 2102*a*. In embodiments, the seal 2102*c* is made of a foam material for engaging and sealing the nozzle of a bottle/container/jar on which the lid assembly 2100 is attached.

As shown in FIG. 24, when the inner lid 2102*a* is assembled within the outer lid 2102*b*, the inner lid 2102*a* may be fully set within the cavity of the outer lid 2102*b*. For example, a bottom edge 2130*b* of the outer lid 2102*b* may extend further downward than a bottom edge 2130*a* of the inner lid 2102*a*, such that a gap is defined between the bottom edges 2130*a* of the inner lid 2102*a* and the bottom edge 2130*b* of the outer lid 2102*b*. Thus, the bottom edge 2130*a* is offset inward from the bottom edge 2130*b* to thereby define the gap 2132. In other embodiments, however, the bottom edges 2130*a*,2130*b* may be aligned with each other such that they are not offset relative to each other but instead terminate at substantially same depth, such that no gap is defined there-between.

This invention has been described with reference to illustrative embodiments, and is not meant to be construed in a limiting sense. It will be apparent to one skilled in the art that elements or process steps from one or more embodiments described herein may be used in combination with elements or process steps from one or more other embodiments described herein, and that the present invention is not limited to the specific embodiments provided herein but only as set forth in the accompanying claims. Various modifications of the illustrative embodiments, as well as additional embodiments to the invention, will be apparent to persons skilled in the art upon reference to this description

What is claimed is:

1. A lid assembly for a jar, the lid assembly comprising:

an outer cap defining a first cavity, the outer cap having an outer circular top wall and a cylindrical sidewall extending downward from the outer circular top wall;

an inner cap provided in the first cavity, the inner cap having a first portion and a second portion, the first portion having an annular surface and first cylindrical sidewalls extending downward from the annular surface, the annular surface extending around the second portion and being spaced from the outer circular top wall, the second portion having second cylindrical sidewalls and an inner circular top wall, the second cylindrical sidewalls extending upward from the annular surface and terminating at the inner circular top wall, wherein:

the annular surface of the first portion is spaced from the outer circular top wall of the outer cap, the first cylindrical sidewall of the first portion of the inner cap contacts the cylindrical sidewall of the outer cap, the second cylindrical sidewall of the second portion of the inner cap is spaced from the cylindrical sidewall of the outer cap, and the inner circular top wall of the second portion of the inner cap contacts the outer circular top wall of the outer cap; and a seal provided on the inner circular top wall of the second portion of the inner cap.

2. The lid assembly of claim 1, wherein the outer cap is aluminum and/or the inner cap is aluminum.

3. The lid assembly of claim 1, wherein the inner cap is adhered to the outer cap.

4. The lid assembly of claim 3, further comprising an adhesive between the inner circular top wall of the second portion of the inner cap and the cylindrical sidewall of the outer cap.

5. The lid assembly of claim 3, further comprising an adhesive between the first cylindrical sidewall of the first portion of the inner cap and the cylindrical sidewall of the outer cap.

6. The lid assembly of claim 3, further comprising an adhesive between:

the inner circular top wall of the second portion of the inner cap and the cylindrical sidewall of the outer cap, and the first cylindrical sidewall of the first portion of the inner cap and the cylindrical sidewall of the outer cap.

7. The lid assembly of claim 1, wherein the outer cap is anodized.

8. A lid assembly, comprising:

an outer cap defining a first cavity, the outer cap having an outer circular top wall and a cylindrical sidewall extending from the outer circular top wall; and an inner cap receivable in the first cavity, the inner cap comprising:

a first annular portion providing a first diameter, and a second annular portion extending from the first annular portion and providing a second diameter different than the first diameter;

wherein the inner cap defines a second cavity; and wherein the second annular portion provides a thread that extends into the second cavity, wherein the thread is configured to threadably engage with a thread of a jar; and wherein the second annular portion is to contact the outer circular top wall.

9. The lid assembly of claim 8, further comprising a seal receivable in the second cavity.

10. The lid assembly of claim 8, further comprising an adhesive to adhere the second annular portion to the outer circular top wall.

11. The lid assembly of claim 8, wherein a bottom edge of the outer cap extends beyond a bottom edge of the inner cap.

12. A lid assembly, comprising:

an outer cap defining a first cavity, the outer cap having a first top wall and a first sidewall extending from the first top wall; and an inner cap receivable in the cavity and defining a second cavity for receiving a jar, the inner cap comprising:

a second top wall to contact the first top wall, a second sidewall extending from second top wall, a third top wall extending from the second sidewall, a third sidewall extending from the third top wall, and a thread extending into the second cavity.

13. The lid assembly of claim 12, further comprising an adhesive to adhere the second top wall to the first top wall.

14. The lid assembly of claim 12, further comprising a seal receivable in the second cavity.

15. The lid assembly of claim 12, wherein a bottom edge of the outer cap extends beyond a bottom edge of the inner cap.

* * * * *